US007805100B2

(12) United States Patent
Miyadera

(10) Patent No.: US 7,805,100 B2
(45) Date of Patent: Sep. 28, 2010

(54) MISREGISTRATION AMOUNT DETECTOR, MISREGISTRATION AMOUNT DETECTING METHOD, AND STORAGE MEDIUM

(75) Inventor: Tatsuya Miyadera, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/336,840

(22) Filed: Dec. 17, 2008

(65) Prior Publication Data

US 2009/0196636 A1 Aug. 6, 2009

(30) Foreign Application Priority Data

Dec. 26, 2007 (JP) ..... 2007-334400

(51) Int. Cl.
*G03G 15/01* (2006.01)

(52) U.S. Cl. ..... 399/301; 399/49; 399/72; 399/394

(58) Field of Classification Search ..... 399/49, 399/72, 299, 301, 394, 396
See application file for complete search history.

(56) References Cited

U.S. PATENT DOCUMENTS 5,854,958 A * 12/1998 Tanimoto et al. ..... 399/49
2008/0038024 A1 2/2008 Miyadera
2008/0069602 A1 3/2008 Miyadera
2008/0170868 A1 7/2008 Miyadera
2008/0212986 A1 9/2008 Miyadera

FOREIGN PATENT DOCUMENTS

| | | |
|---|---|---|
| JP | 3186587 | 7/2001 |
| JP | 2003-266798 | 9/2003 |
| JP | 2006-235560 | 9/2006 |

* cited by examiner

*Primary Examiner*—Hoang Ngo
(74) *Attorney, Agent, or Firm*—IPUSA, PLLC

(57) ABSTRACT

A misregistration amount detector in a tandem image forming apparatus having a conveying body configured to convey paper on which a color image is to be printed is disclosed. The misregistration amount detector includes an image creating part configured to create, on the conveying body, a first pattern for detecting the amount of misregistration of an image position related to a first color relative to an image position related to a second color other than the first color and a second pattern for measuring the conveyance speed of the conveying body, the first pattern and the second pattern being side by side in the conveyance direction of the conveying body, and a reading part configured to read the first pattern and the second pattern created on the conveying body by the image creating part.

12 Claims, 13 Drawing Sheets

MISREGISTRATION AMOUNT DETECTOR, MISREGISTRATION AMOUNT DETECTING METHOD, AND STORAGE MEDIUM

BACKGROUND OF THE INVENTION

1. Field of the Invention

The present invention relates to a unit configured to detect the amount of misregistration between multiple color images in the case of obtaining an image visualized by superposing multiple colors in a tandem-type image forming apparatus.

2. Description of the Related Art

According to a so-called "tandem" image forming apparatus, a different image forming part is used for each of four colors, and a (composite) color image is formed by superposing toner images directly on paper or on an intermediate transfer belt.

Such a tandem image forming apparatus cannot produce stable color images if the color toner images are superposed at slightly different positions. Therefore, such misregistration correction is commonly performed as detecting misregistration correction patterns for the respective colors formed on the conveyor body (conveyor belt) of the image forming apparatus and superposing the four colors on the same position. In general, the results of detection of color patterns (cyan, magenta, and yellow) and the result of detection of a reference color pattern (black) are compared, and the amounts of misregistration of the color patterns relative to the reference color pattern are calculated. (See, for example, Japanese Laid-Open Patent Application No. 2003-266798 and Japanese Patent No. 3186587.)

On the other hand, since the conveyor belt, on which the misregistration correction patterns are formed, is not uniform in thickness, the surface velocity of the conveyor belt varies to cause detection error.

Therefore, in order to cancel the effect of the above-described detection error due to the non-uniform thickness of the conveyor belt, misregistration correction patterns are formed on the conveyor belt over its overall length or more (for one turn or more), and then the amount of misregistration is detected.

However, forming misregistration correction patterns on the conveyor belt over its overall length or more and detecting the amount of registration as described above cause the problem of a longer time for forming and detecting the misregistration correction patterns.

SUMMARY OF THE INVENTION

According to one embodiment of the present invention, a misregistration amount detector, a misregistration amount detecting method, and a storage medium storing a program for causing a computer to execute the misregistration amount detecting method are provided in which the above-described problem may be solved or reduced.

According to one embodiment of the present invention, a misregistration amount detector, a misregistration amount detecting method, and a storage medium storing a program for causing a computer to execute the misregistration amount detecting method are provided that make it possible to detect misregistration in a shorter period of time without detection error due to the unevenness (non-uniformity) of the thickness of a conveyor belt.

According to one embodiment of the present invention, a misregistration amount detector in a tandem image forming apparatus having a conveying body configured to convey paper on which a color image is to be printed is provided that includes an image creating part configured to create, on the conveying body, a first pattern for detecting an amount of misregistration of an image position related to a first color relative to an image position related to a second color other than the first color and a second pattern for measuring a conveyance speed of the conveying body, the first pattern and the second pattern being side by side in a conveyance direction of the conveying body, and a reading part configured to read the first pattern and the second pattern created on the conveying body by the image creating part.

According to one embodiment of the present invention, a misregistration amount detecting method in a tandem image forming apparatus having a conveying body configured to convey paper on which a color image is to be printed is provided that includes the steps of (a) creating, on the conveying body, a first pattern for detecting an amount of misregistration of an image position related to a first color relative to an image position related to a second color other than the first color and a second pattern for measuring a conveyance speed of the conveying body, the first pattern and the second pattern being side by side in a conveyance direction of the conveying body, and (b) reading the first pattern and the second pattern created on the conveying body by the image creating part.

According to one embodiment of the present invention, a computer-readable storage medium storing a program for causing a computer to execute a misregistration amount detecting method in a tandem image forming apparatus having a conveying body configured to convey paper on which a color image is to be printed is provided, wherein the misregistration amount detecting method includes the steps of (a) creating, on the conveying body, a first pattern for detecting an amount of misregistration of an image position related to a first color relative to an image position related to a second color other than the first color and a second pattern for measuring a conveyance speed of the conveying body, the first pattern and the second pattern being side by side in a conveyance direction of the conveying body, and (b) reading the first pattern and the second pattern created on the conveying body by the image creating part.

Thus, according to one aspect of the present invention, there are provided a misregistration amount detector and misregistration amount detecting method that make it possible to perform misregistration detection without detection error due to the unevenness (non-uniformity) of the thickness of a conveyor belt in a shorter period of time, and a computer-readable storage medium storing a program for causing a computer to execute the misregistration amount detecting method.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

(Operating Principle of Misregistration Amount Detector According to this Embodiment)

Figure 1:
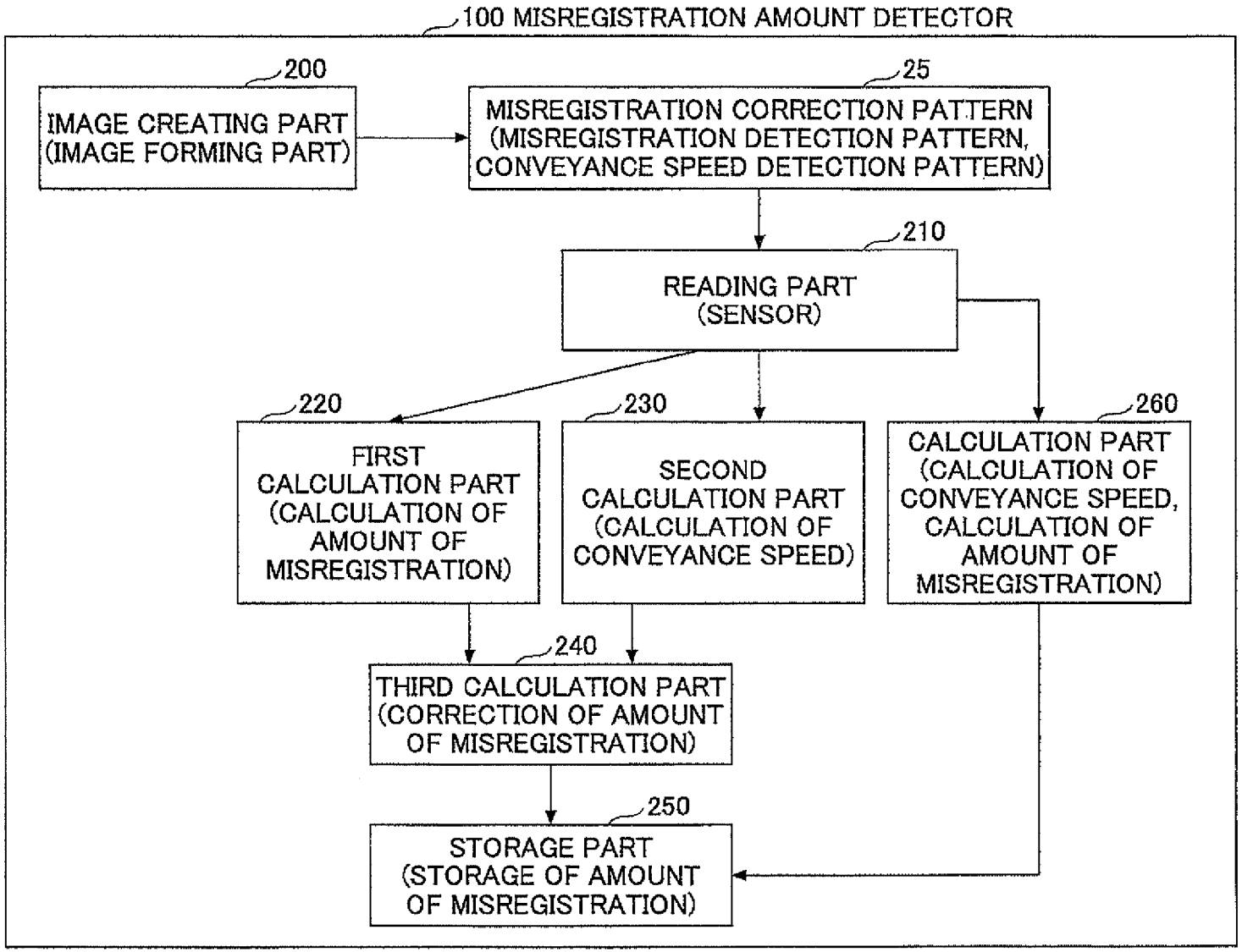
FIG. 1 is a diagram illustrating the operating principle of a misregistration amount detector according to an embodiment of the present invention.

A description is given, with reference to FIG. 1, of the operating principle of a misregistration amount detector 100 according to this embodiment. FIG. 1 is a diagram illustrating the operating principle of the misregistration amount detector 100 according to this embodiment.

The misregistration amount detector 100 includes an image creating part 200, a reading part 210, a first calculation part 220, a second calculation part 230, a third calculation part 240, a storage part 250, and a calculation part 260.

The image creating part 200 creates (forms) a misregistration detection pattern and a conveyance speed detection pattern parallel to each other in a conveyance direction on the conveyor (conveying body) of a tandem color image forming apparatus. The misregistration detection pattern is for detecting the amount of misregistration between the image position of a specific color and the image position of a color other than the specific color in the image forming apparatus. The conveyance speed detection pattern is for detecting the conveyance speed of the conveyor.

The reading part 210 is a sensor that reads the misregistration detection pattern and conveyance speed detection pattern created by the image creating part 200.

The first calculation part 220 calculates the amount of misregistration in the conveyance direction and the amount of misregistration in a direction perpendicular to the conveyance direction, using the position information of the misregistration detection pattern read by the reading part 210.

The second calculation part 230 calculates the actual conveyance speed of the conveyor, using the position information of the conveyance speed detection pattern read by the reading part 210.

The third calculation part 240 corrects the amounts of misregistration calculated by the first calculation part 220, using the conveyance speed calculated by the second calculation part 230.

The calculation part 260 calculates the actual conveyance speed of the conveyor, using the position information of the conveyance speed detection pattern read by the reading part 210, and calculates the amount of misregistration in the conveyance direction and the amount of misregistration in a direction perpendicular to the conveyance direction, using the calculated conveyance speed and the position information of the misregistration detection pattern read by the reading part 210.

The storage part 250 stores the amounts of misregistration corrected by the third calculation part 240 in a storage unit (storage medium) such as a random access memory (RAM) (not graphically illustrated in FIG. 1). The storage part 250 stores the amounts of misregistration corrected by the calculation part 260 in the storage unit.

According to one operation of the misregistration amount detector 100 of this embodiment, the image creating part 200 creates a misregistration detection pattern and a conveyance speed detection pattern on the conveyor. Then, the reading part 210 reads the position information of these patterns. Next, the first calculation part 220 calculates the above-described two kinds of amounts of misregistration from the position information of the misregistration detection pattern read by the reading part 210, and the second calculation part 230 calculates the actual conveyance speed of the conveyor from the position information of the conveyance speed detection pattern read by the reading part 210. Then, the third calculation part 240 corrects the two kinds of amounts of misregistration calculated by the first calculation part 220, using the actual conveyance speed calculated by the second calculation part 230. Finally, the storage part 250 stores the corrected two kinds of amounts of misregistration in the storage unit. Thereby, the misregistration amount detector 100 ends processing.

According to another operation of the misregistration amount detector 100 of this embodiment, the image creating part 200 creates a misregistration detection pattern and a conveyance speed detection pattern on the conveyor. Then, the reading part 210 reads the position information of these patterns. Next, the calculation part 260 calculates the actual conveyance speed of the conveyor from the position information of the conveyance speed detection pattern read by the reading part 210, and calculates the two kinds of amounts of misregistration based on this calculated conveyance speed and the position information of the misregistration detection pattern read by the reading part 210. Finally, the storage part 250 stores these two kinds of amounts of misregistration in the storage unit. Thereby, the misregistration amount detector 100 ends processing.

A detailed description is given below of processing operations of these parts 200 through 260.

(Image Creating Part 200 of Misregistration Amount Detector 100 According to this Embodiment)

(a) Processing Operation of Image Creating Part 200 of Misregistration Amount Detector 100

Figure 2:
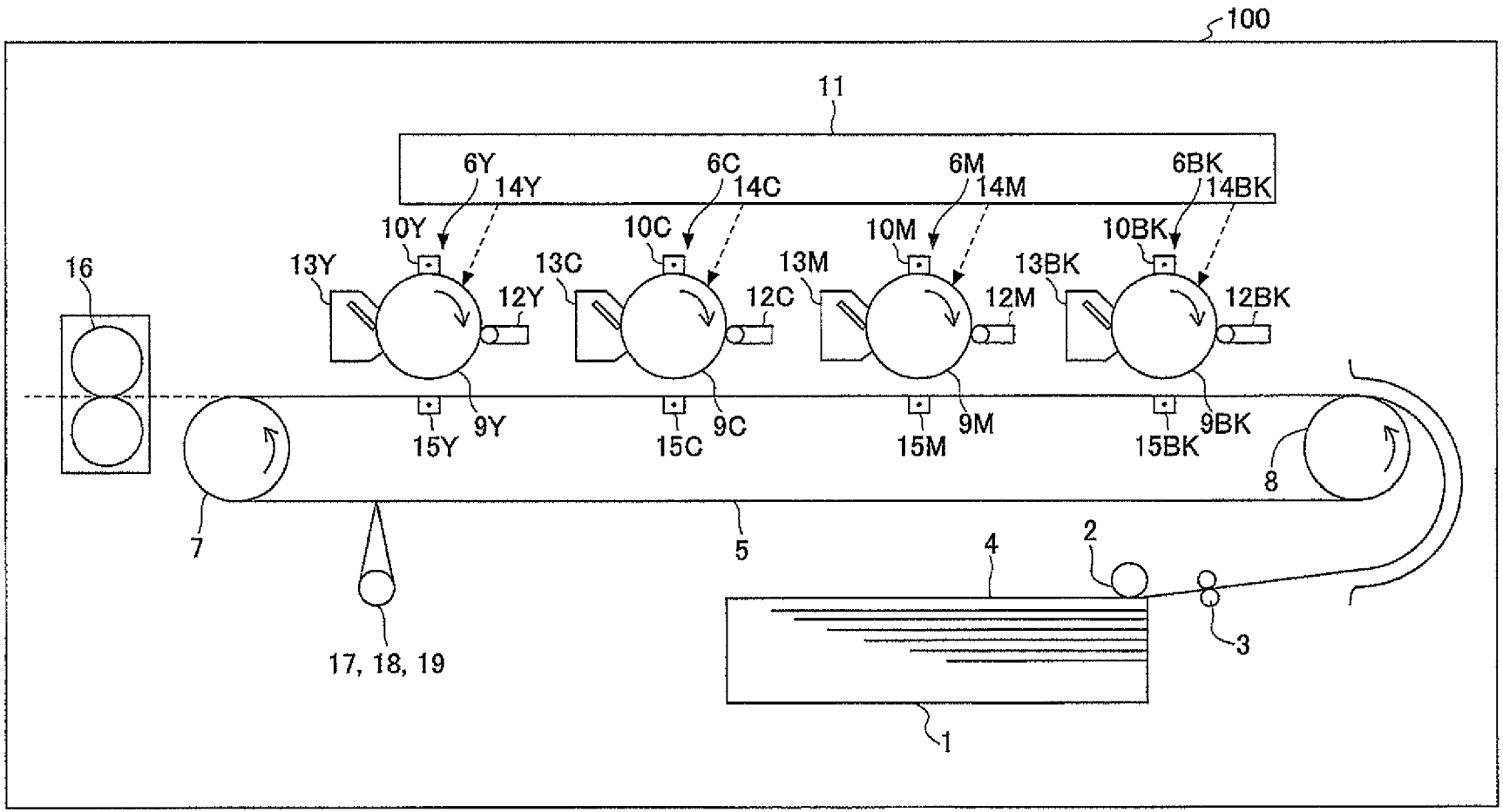
FIG. 2 is a schematic diagram illustrating a configuration of the misregistration amount detector according to the embodiment of the present invention.

A description is given, with reference to FIG. 2, of the image creating part 200 of the misregistration amount detector 100 according to this embodiment. FIG. 2 is a schematic diagram illustrating a configuration of the misregistration amount detector 100 (and a color image forming apparatus) according to this embodiment.

According to this embodiment, the misregistration amount detector 100 may be provided in a tandem color image forming apparatus to correct a misregistration between the positions of color images created therein. Accordingly, the image creating part 200 of the misregistration amount detector 100 and the image creation part of the tandem color image forming apparatus perform the same processing operation using the same mechanism. Therefore, a description is given below of the configuration and processing operation of the image creation part of the color image forming apparatus.

The color image forming apparatus according to this embodiment includes a paper feed tray 1, a paper feed roller 2, separation rollers 3, recording paper 4, a conveyor belt 5, image forming parts 6BK, 6M, 6C, and 6Y, a drive roller 7, a driven roller 8, photosensitive body drums 9BK, 9M, 9C, and 9Y, chargers 10BK, 10M, 10C, and 10Y, an exposure unit 11, developing units 12BK, 12M, 12C, and 12Y, dischargers 13BK, 13M, 13C, and 13Y, transfer units 15BK, 15M, 15C, and 15Y, a fuser 16, and sensors 17, 18, and 19. Laser (light) beams 14BK, 14M, 14C, and 14Y, which are exposure beams for corresponding image colors, are emitted from the exposure unit 11. Here, those referred to by suffixes BK, M, C, and Y correspond to color images of black, magenta, cyan, and yellow, respectively.

According to the color image forming apparatus of this embodiment, the image forming parts 6BK, 6M, 6C, and 6Y, which form respective color images of black, which is a reference color, magenta, cyan, and yellow, which are other colors, are arranged along the conveyor belt 5, which is an endless carrier, in its conveyance direction as illustrated in FIG. 2. That is, the image forming parts 6BK, 6M, 6C, and 6Y are disposed along the conveyor belt 5, which conveys the paper (recording paper) 4 separated and fed from the paper feed tray 1 by the paper feed roller 2 and the separation rollers 3, in this order from the upstream side of the conveyance direction of the conveyor belt 5.

These image forming parts 6BK, 6M, 6C, and 6Y are only different in the color of toner for forming an image, and have the same internal configuration. Accordingly, in the following, a specific description is given of each component (element) of the image forming part 6BK, and a description of the other image forming parts 6M, 6C, and 6Y is omitted because the image forming parts 6M, 6C, and 6Y perform the same processing operation as the image forming part 6BK.

The conveyor belt 5 is an endless belt wound (engaged) around the drive roller 7 and the driven roller 8. The drive roller 7 is rotated by a drive motor (not graphically illustrated), so that the drive motor, the drive roller 7, and the driven roller 8 operate as a drive unit that causes the conveyor belt 5, which is an endless carrier, to move.

At the time of forming images, the sheets of paper 4 contained in the paper feed tray 1 are fed one after another beginning with one at the top. Each sheet of paper 4 is attracted and adhered to the conveyor belt 5 by electrostatic attraction and adhesion, and is conveyed by the rotating conveyor belt 5 to the first image forming part 6BK, where a black toner image is transferred onto the sheet of paper 4.

The image forming part 6BK includes the photosensitive body drum 9BK as a photosensitive body and the charger 10BK, the exposure unit 11, the developing unit 12BK, a photosensitive body cleaner (not graphically illustrated), and the discharger 13BK, which are disposed around the photosensitive body drum 9BK. The exposure unit 11 is configured to emit the laser beams 14BK, 14M, 14C, and 14Y, which are exposure beams corresponding to the colors of the images formed by the image forming parts 6BK, 6N, 6C, and 6Y, respectively.

Figure 3:
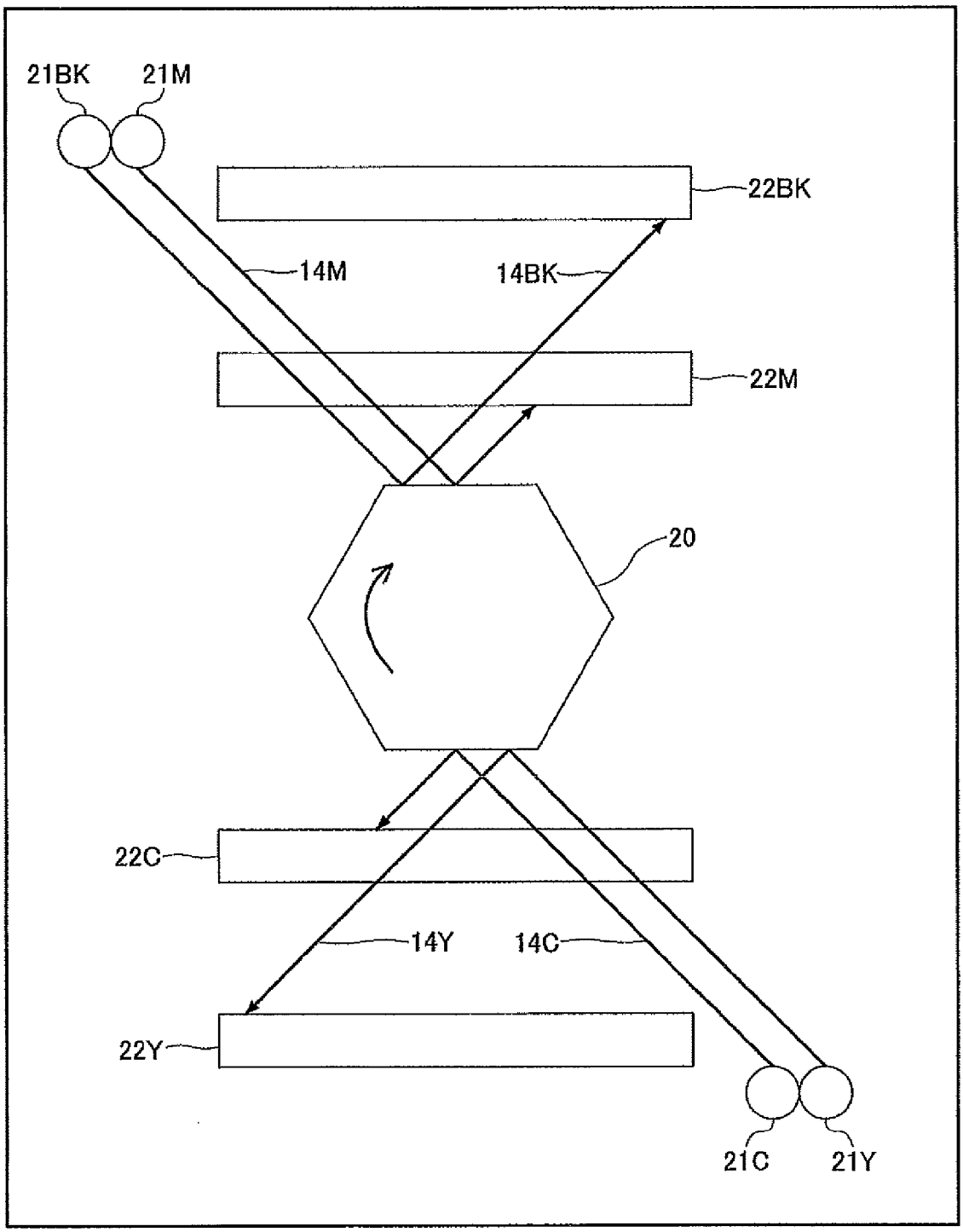
FIG. 3 is a diagram illustrating the inside of an exposure unit according to the embodiment of the present invention.

Here, a description is given, with reference to FIG. 3, of the exposure unit 11. FIG. 3 is a diagram illustrating the inside of the exposure unit 11. The laser beams 14BK, 14M, 14C, and 14Y are emitted from laser diodes 21BK, 21M, 21C, and 21Y, respectively, which are light sources. The emitted laser beams 14BK, 14M, 14C, and 14Y are reflected by a reflecting mirror 20 to go through corresponding optical systems 22BK, 22M, 22C, and 22Y, thereby having their respective optical paths adjusted so as to scan the surfaces of the photosensitive body drums 9BK, 9M, 9C, and 9Y. The reflecting mirror 20, which is a polygon mirror of a hexahedron, can rotate to cause an exposure beam to scan for one line in the main scanning direction per polygon mirror surface. Further, scanning is performed with the single polygon mirror 20 with respect to the four laser diodes 21BK, 21M, 21C, and 21Y serving as light sources.

The laser beams 14BK and 14M perform scanning using one of opposed reflecting surfaces of the polygon mirror 20 and the laser beams 14C and 14Y perform scanning using the other one of the opposed reflecting surfaces of the polygon mirror 20. As a result, it is possible to expose the four different photosensitive body drums 9BK, 9M, 9C, and 9Y to light simultaneously. Each of the optical systems 22BK, 22M, 22C, and 22Y includes an fθ lens that makes constant the scanning speed of the corresponding laser beam (light) 22BK, 22M, 22C, or 22Y on the corresponding photosensitive body drum BK, 9M, 9C, or 9Y and a deflecting mirror that deflects the corresponding laser beam (light) 22BK, 22M, 22C, or 22Y.

At the time of forming an image, the exterior cylindrical surface of the photosensitive body drum 9BK is evenly charged by the charger 10BK in a dark place, and is thereafter exposed to the laser beam 14BK corresponding to a black image from the exposure unit 11, so that an electrostatic latent image is formed on the exterior cylindrical surface of the photosensitive body drum 9BK. The developing unit 12BK makes this electrostatic latent image visible with black toner, so that a black toner image is formed on the photosensitive body drum 9BK.

This toner image is transferred onto the paper 4 at a transfer position, or where the photosensitive body drum 9BK and the paper 4 on the conveyor belt 5 come into contact, through the action of the transfer unit 15BK. As a result of this transfer, the black image is formed on the paper 4 with the black toner.

The paper 4, onto which the black toner image has been transferred in the image forming part 6BK, is conveyed to the next image forming part 6M by the conveyor belt 5. In the image forming part 6M, a magenta toner image is formed on the photosensitive body drum 9M in the same image forming process as in the image forming part 6BK, and the magenta toner image is transferred onto the paper 4 so as to be superposed on the black image formed thereon.

The paper 4 is further conveyed to the next image forming parts 6C and 6Y, and a cyan toner image formed on the photosensitive body drum 9C and a yellow toner image formed on the photosensitive body drum 9Y are transferred onto the paper 4 so as to be superposed on the black and magenta images in the same manner. Thus, a full color image is formed on the paper 4. The paper 4 on which this full color superposed (composite) image is formed is removed from the conveyor belt 5 to have the image fused (fixed) in the fuser 16, and is thereafter discharged outside the image forming apparatus.

On the other hand, color toner images may not be superposed where they should be superposed, so that there may be misregistration between colors. If there is color misregistration, it is necessary to correct the misregistration between color toner images. This correction is performed by aligning the position of each of magenta, cyan, and yellow images with the position of a black image.

(b) Configuration of Misregistration Correction Pattern

Figure 4:
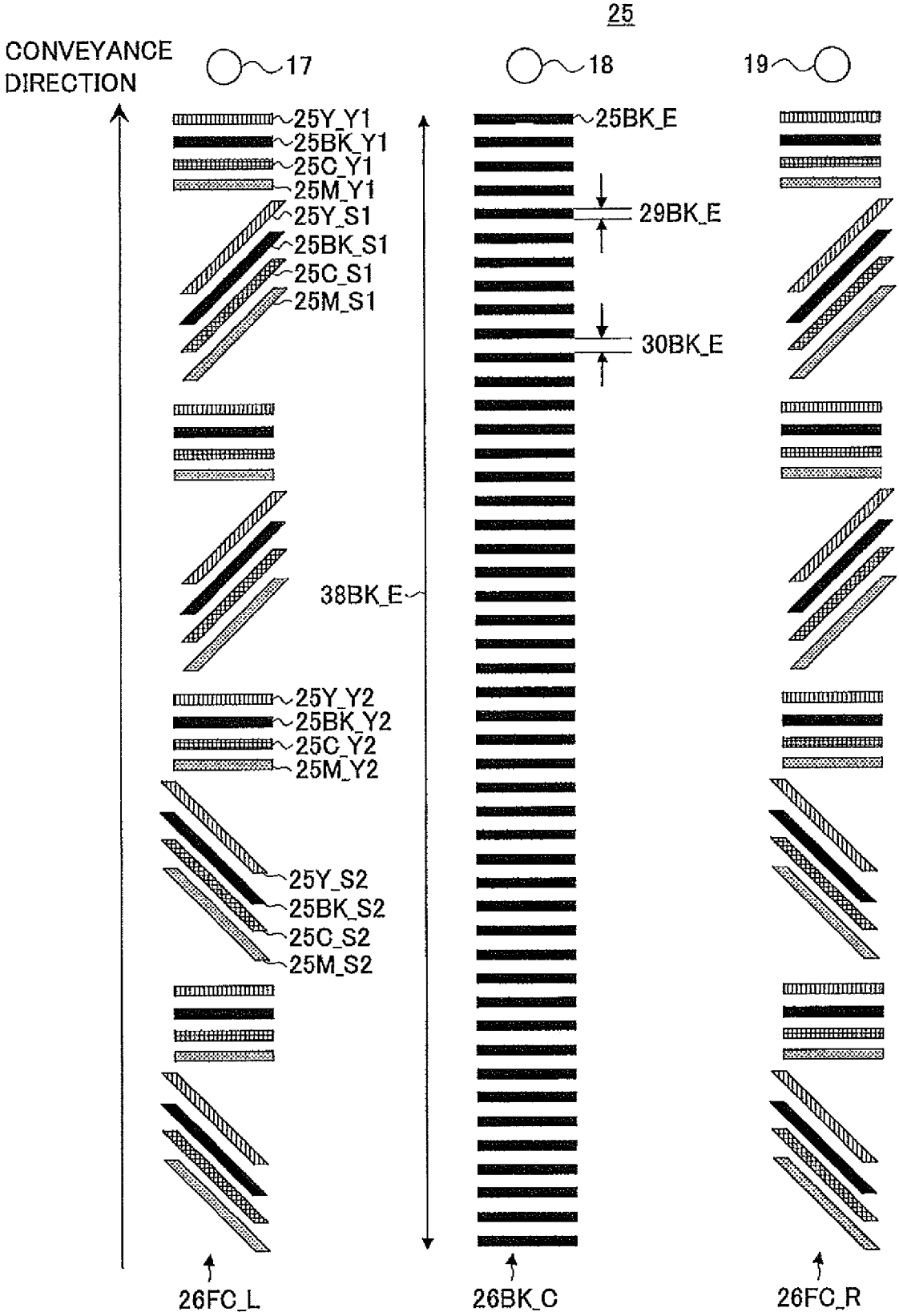
FIG. 4 is a diagram illustrating a misregistration correction pattern according to the embodiment of the present invention.

Next, a description is given, with reference to FIG. 4, of a misregistration correction pattern. FIG. 4 is a diagram illustrating a misregistration correction pattern 25 according to this embodiment. (See also FIG. 1.) The misregistration correction pattern 25 includes misregistration correction pattern columns (lines) 26FC_R and 26FC_L for detecting the amount of misregistration between the position of a black image and each of the positions of magenta, cyan, and yellow images, and a conveyance speed detection pattern column (line) 26BK_C for detecting the conveyance speed of the conveyor belt 5.

According to this embodiment, the pattern column 26BK_C is formed of black rectilinear patterns 25BK_E perpendicular to the conveyance direction as illustrated in FIG. 4. Alternatively, however, the rectilinear patterns 25BK_E may be created in any of magenta, cyan, yellow, and may be oblique patterns having an inclination relative to the conveyance direction. Further, the pattern column 26BK_C may include multiple colors if the individual patterns of the pattern column 26BK_C are each single-colored, are equally shaped, and are created at regular intervals.

Further, according to this embodiment, as illustrated in FIG. 4, each of the pattern columns 26FC_R and 26FC_L includes first misregistration detection patterns 25BK_Y1, 25M_Y1, 25C_Y1, 25Y_Y1, 25BK_Y2, 25M_Y2, 25C_Y2, and 25Y_Y2 that are rectilinear patterns perpendicular to the conveyance direction, second misregistration detection patterns 25BK_S1, 25M_S1, 25C_S1, and 25Y_S1 that are oblique patterns having an inclination angle of $\pi/4$ with respect to a direction perpendicular to the conveyance direction, and third misregistration detection patterns 25BK_S2, 25M_S2, 25C_S2, and 25Y_S2 that are oblique patterns having an inclination angle of $3\pi/4$ with respect to the direction perpendicular to the conveyance direction. Hereinafter, the first misregistration detection patterns 25BK_Y1 and 25BK_Y2 may be collectively referred to by reference numeral 25BK_Y. The first misregistration detection patterns 25M_Y1 and 25M_Y2, 25C_Y1 and 25C_Y2, and 25Y_Y1 and 25Y_Y2 may also be collectively referred to by reference numerals 25M_Y, 25C_Y, and 25Y_Y, respectively.

Further, in FIG. 4, the pattern column 26FC_L, the pattern column 26BK_C, and the pattern column 26FC_R, each extending in the conveyance direction, are graphically illustrated in this order relative to the direction perpendicular to the conveyance direction (from left to right). However, this order may be changed.

Here, in the misregistration amount detector 100 according to this embodiment, the misregistration correction pattern 25, which is made up of black, magenta, cyan, and yellow toner images, is formed on the conveyor belt 5 in the same process as a color image is formed on the paper 4. Further, each of the image forming parts 6BK, 6M, 6C, and 6Y corresponds to the image creating part 200 in this embodiment.

Further, according to this embodiments the conveyor belt 5 may be an intermediate transfer belt. In this case, the image creating part 200 creates the misregistration correction pattern 25 on the intermediate transfer belt.

Conventionally, a misregistration correction pattern is formed over the overall length or more (one turn or more) of a conveyor belt in order to cancel the effect of detection error due to the non-uniformity of the thickness of the conveyor belt. According to this embodiment, the overall length of the misregistration correction pattern 25 in the conveyance direction (overall length 38BK_E) may be an integral multiple of the circumference of the photosensitive body drum 9BK. In the case illustrated in FIG. 4, the overall length 38BK_E is twice the circumference of the photosensitive body drum 9BK, and is less than or equal to a third of the overall length (one turn) of the conveyor belt 5.

Therefore, according to this embodiment, the misregistration correction pattern 25 is created and detected in a shorter period of time than in misregistration correction using a conventional misregistration correction pattern.

(Reading Part 210 of Misregistration Amount Detector 100)

(a) Overview of Reading Part 210

Figure 5:
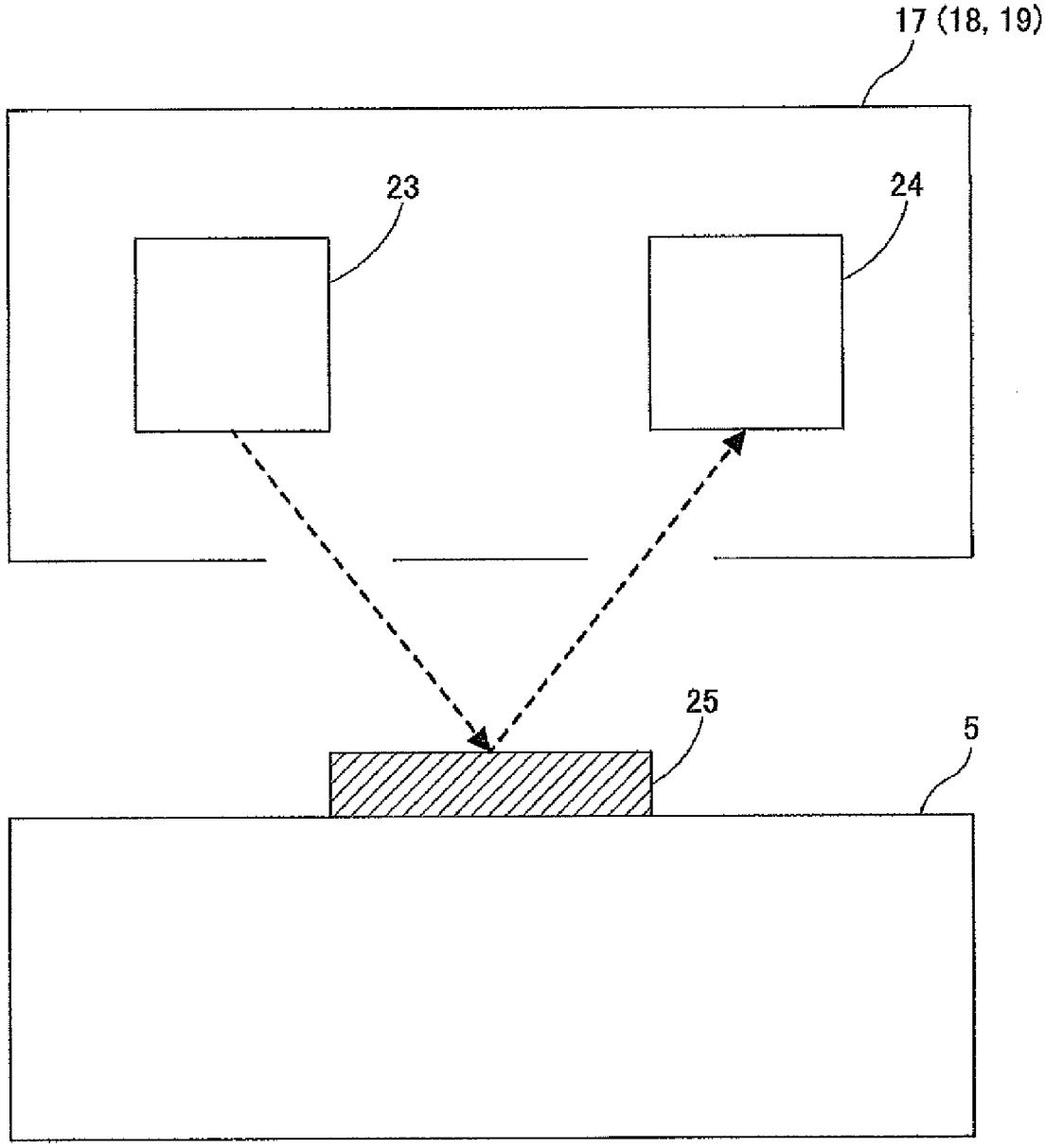
FIG. 5 is an enlarged view of a sensor according to the embodiment of the present invention.
Figure 6:
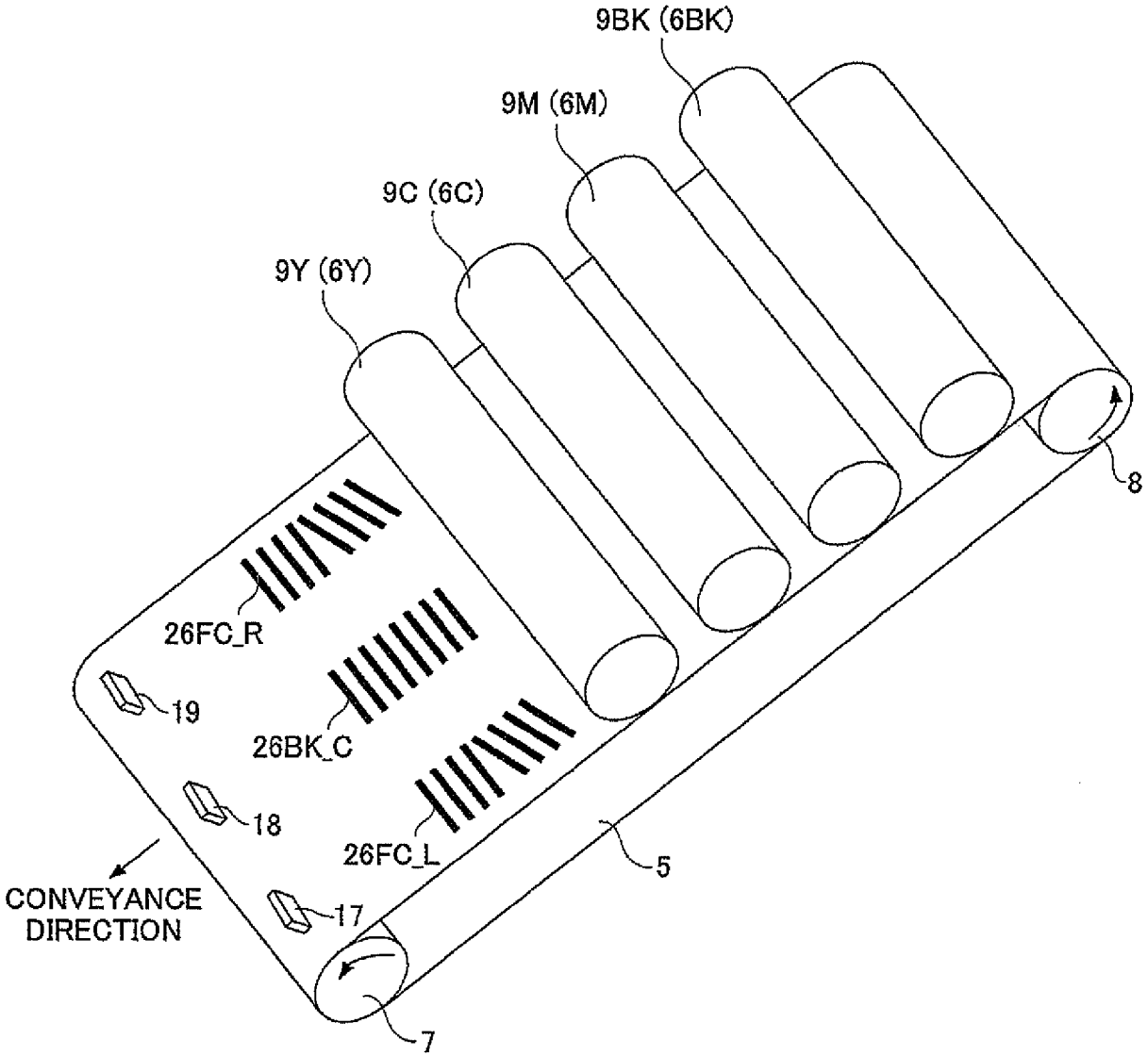
FIG. 6 is a schematic diagram illustrating the sensors and their peripheral part according to the embodiment of the present invention.

A description is given, with reference to FIG. 5 and FIG. 6, of operations and configurations of sensors that are the reading part 210 of the misregistration amount detector 100 according to this embodiment. FIG. 5 is an enlarged view of one of the sensors 17, 18, and 19. FIG. 6 is a schematic diagram illustrating the sensors 17, 18, and 19 and their peripheral part.

Referring to FIG. 5, each of the sensors 17, 18, and 19 includes a light-emitting part 23 and a light-receiving part 24. The light-emitting part 23 emits exposure light onto the misregistration correction pattern formed on the conveyor belt 5, and the reflected light is received by the light-receiving part 24, so that each of the sensors 17, 18, and 19 detects the misregistration correction pattern 25.

Further, as illustrated in FIG. 6, the sensors 17, 18, and 19 are provided on the downstream side of the image forming part 6Y so as to be opposed to the conveyor belt 5. The sensors 17, 18, and 19 are supported on the same substrate (not graphically illustrated) so as to be along a direction perpendicular to the conveyance direction of the paper 4.

(b) Detection of Misregistration Correction Pattern 25

Figure 7:
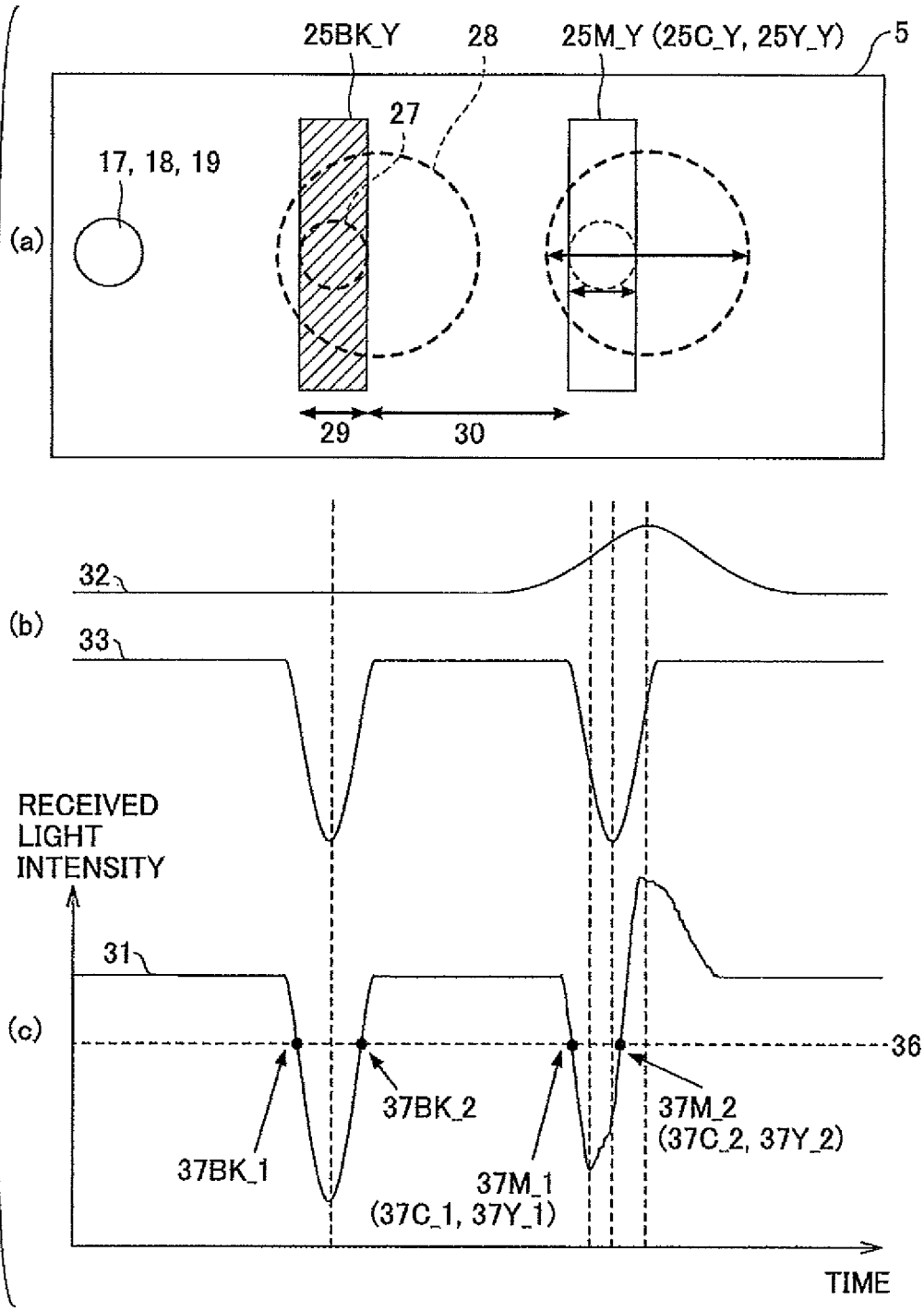
FIG. 7 is a diagram for illustrating the principle of detection of the misregistration correction pattern by the sensor according to this embodiment.

A description is given, with reference to FIG. 7, of the principle of detection of a misregistration correction pattern according to this embodiment. FIG. 7 is a diagram for illustrating the principle of detection of the misregistration correction pattern 25 by the sensor 17 (18, 19).

Referring to FIG. 7, (c) shows a result of detection of reflected light received by the light-receiving part 24 (detection result 31), and (b) shows detected intensity of light of diffuse reflection received by the light-receiving part 24 (detected intensity 32) and detected intensity of light of specular reflection received by the light-receiving part 24 (detected intensity 33). Here, the detection result 31 is the sum of the detected intensity 32 and the detected intensity 33.

Further, in the graph of (c) of FIG. 7, the vertical axis represents the intensity of light received by the light-receiving part 24 and the horizontal axis represents time.

Here, the light of specular reflection refers to light reflected in a direction opposite to the direction of incidence of exposure light at the same angle as the angle of incidence of the exposure light (that is, reflected light whose angle of reflection is $\pi-\theta$, where $\theta$ is an angle of incidence). The light of diffuse reflection refers to reflected light other than the light of specular reflection.

Each of the sensors 17, 18, and 19 determines that an edge of the misregistration correction pattern 25 is detected at each of positions 37BK_1, 37BK_2, 37M_1 (37C_1 and 37Y_1), and 37M_2 (37C_2 and 37Y_2) where the detection result 31 crosses a predetermined threshold 36. According to this embodiment, the midpoint of two edges (for example, the midpoint of the positions 37BK_1 and 37BK_2) detected from the misregistration correction pattern 25 is determined as the position of an image. Alternatively, each of the positions (edges) 37BK_1, 37BK_2, 37M_1 (37C_1 and 37Y_1), and 37M_2 (37C_2 and 37Y_2) detected from the misregistration correction pattern 25 may be determined as the position of an image. The positions 37BK_1 and 37BK_2 may correspond to the edges of the first misregistration detection pattern 25BK_Y of (a) of FIG. 7. The positions 37M_1 (37C_1 and 37Y_1) and 37M_2 (37C_2 and 37Y_2) may correspond to the edges of the first misregistration detection pattern 25M_Y (25C_Y and 25Y_Y) of (a) of FIG. 7.

Further, referring to (a) of FIG. 7, a line width 29 of each of the color misregistration detection patterns 25BK_Y, 25M_Y, 25C_Y, and 25Y_Y in the conveyance direction is substantially equal to a spot size 27 of exposure light in order to improve the signal-to-noise ratio at the time of detection of the misregistration detection patterns 25BK_Y, 25M_Y, 25C_Y, and 25Y_Y. Further, if two of the misregistration detection patterns 25BK_Y, 25M_Y, 25C_Y, and 25Y_Y are simultaneously exposed to light of diffuse reflection, pattern detection cannot be performed normally. Accordingly, an interval (distance) 30 between misregistration detection patterns is greater than a spot size 28 of light of diffuse reflection.

(Calculation Unit of Misregistration Amount Detector 100)

(a) Calculation of Misregistration Amount

Figure 8A:
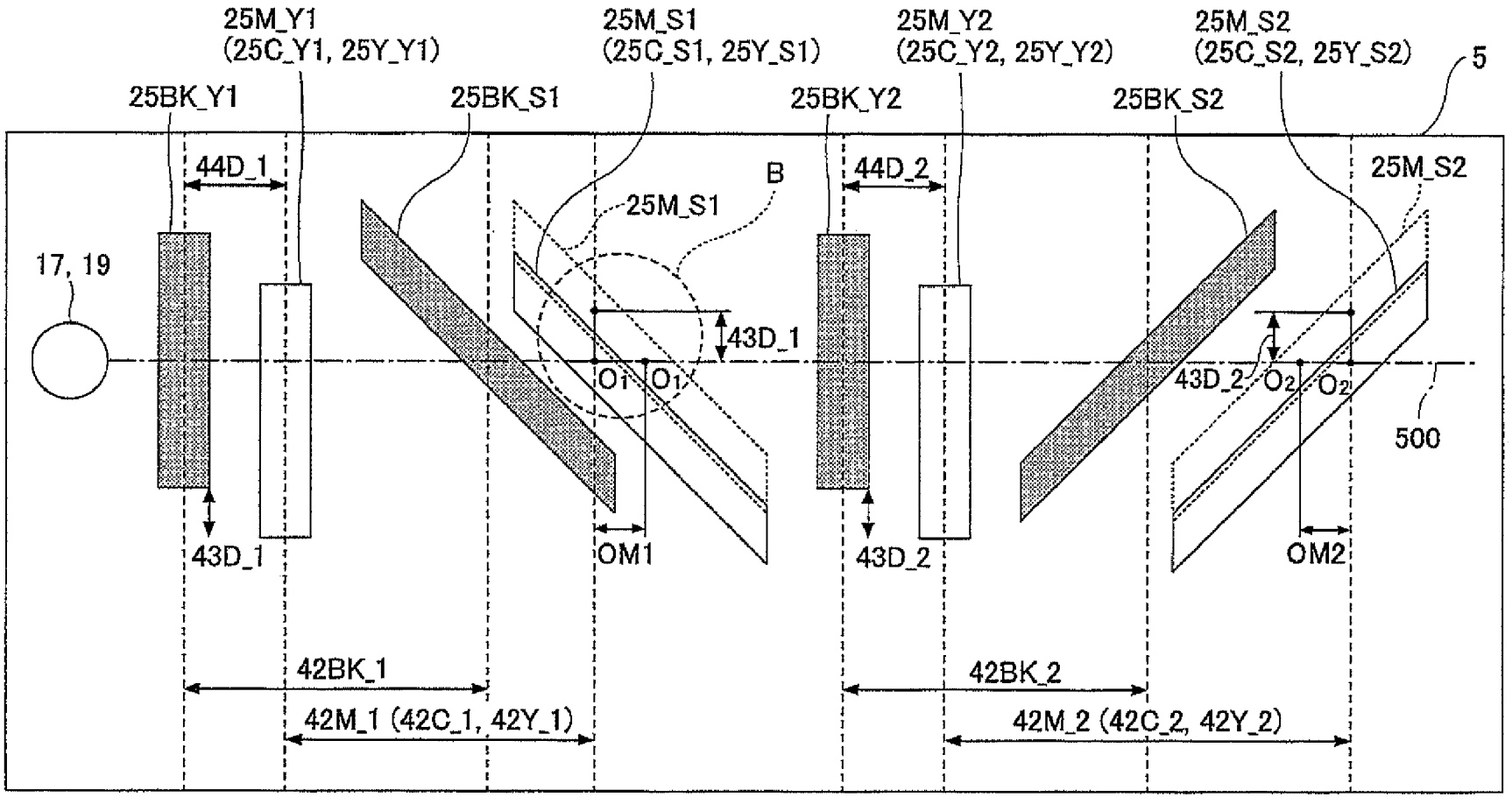
FIGS. 8A and 8B are diagrams illustrating the principle of calculating the amount of misregistration using misregistration detection patterns according to the embodiment of the present invention.
Figure 8B:
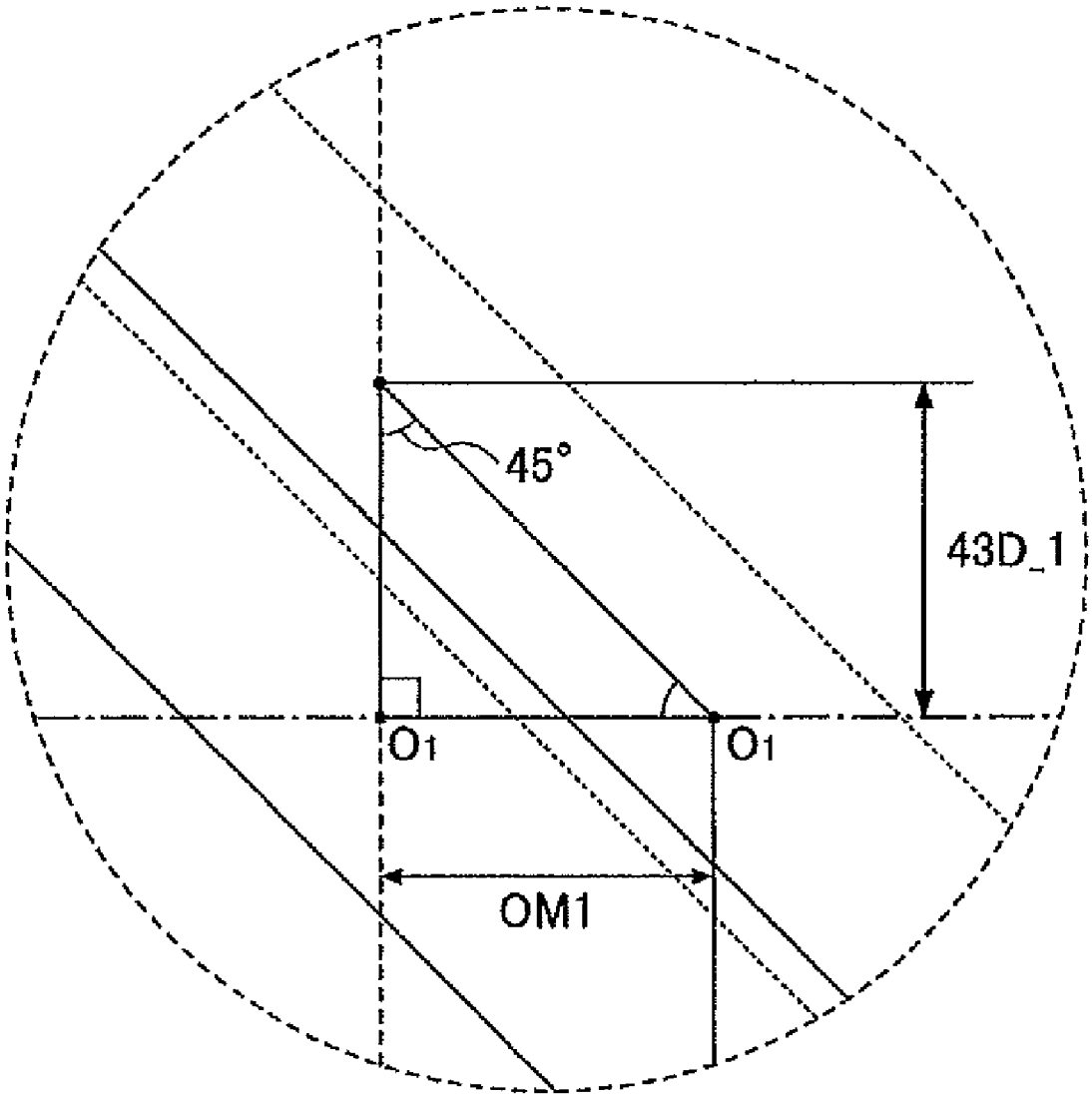

A description is given, with reference to FIGS. 8A and 8B, of calculation of the amount of misregistration using misregistration detection patterns. FIGS. 8A and 8B are diagrams illustrating the principle of calculating the amount of misregistration using misregistration detection patterns.

In FIG. 8A, by way of example, the amount of misregistration is calculated from black and magenta misregistration detection patterns. By replacing the magenta misregistration detection patterns with cyan misregistration detection patterns or yellow misregistration detection patterns, the amount of misregistration relative to a black image can also be detected for a cyan image or a yellow image in the same manner as in the case of a magenta image.

FIG. 8A illustrates the first black misregistration detection patterns 25BK_Y1 and 25BK_Y2, the first magenta misregistration detection patterns 25M_Y1 and 25M_Y2, the second black misregistration detection pattern 25BK_S1, the second magenta misregistration detection pattern 25M_S1, the third black misregistration detection pattern 25BK_S2, and the third magenta misregistration detection pattern 25M_S2. As described above, the magenta misregistration detection patterns 25M_Y1, 25M_Y2, 25M_S1, and 25M_S2 may be replaced with the cyan misregistration detection patterns 25C_Y1, 25C_Y2, 25C_S1, and 25C_S2, respectively, or the yellow misregistration detection patterns 25Y_Y1, 25Y_Y2, 25Y_S1, and 25Y_S2, respectively.

Referring to FIG. 8A, there is an interval (distance) 42BK_1 between the first black misregistration detection pattern 25BK_Y1 and the second black misregistration detection pattern 25BK_S1, and there is an interval (distance) 42BK_2 between the first black misregistration detection pattern 25BK_Y2 and the third black misregistration detection pattern 25BK_S2. Further, there is an interval (distance) 42M_1 between the first magenta misregistration detection pattern 25M_Y1 and the second magenta misregistration detection pattern 25M_S1, and there is an interval (distance) 42M_2 between the first magenta misregistration detection pattern 25M_Y2 and the third magenta misregistration detection pattern 25M_S2. Here, the position of each misregistration detection pattern used to calculate the above-described misregistration detection pattern intervals 42BK_1, 42BK_2, 42M_1, and 42M_2 is the midpoint of the leading (front) edge and the trailing (rear) edge of the misregistration detection pattern detected by the sensor 17 or 19.

In the case of using the cyan misregistration detection patterns 25C_Y1, 25C_Y2, 25C_S1, and 25C_S2, there is an interval 42C_1 between the first cyan misregistration detection pattern 25C_Y1 and the second cyan misregistration detection pattern 25C_S1, and there is an interval 42C_2 between the first cyan misregistration detection pattern 25C_Y2 and the third cyan misregistration detection pattern 25C_S2 as parenthesized in FIG. 8A. In the case of using the yellow misregistration detection patterns 25Y_Y1, 25Y_Y2, 25Y_S1, and 25Y_S2, there is an interval 42Y_1 between the first yellow misregistration detection pattern 25Y_Y1 and the second yellow misregistration detection pattern 25Y_S1, and there is an interval 42Y_2 between the first yellow misregistration detection pattern 25Y_Y2 and the third cyan misregistration detection pattern 25Y_S2 as parenthesized in FIG. 8A.

Then, considering that the second magenta misregistration detection pattern 25M_S1 and the third magenta misregistration detection pattern 25M_S2 are at angles of $\pi/4$ and $3\pi/4$, respectively, with a direction perpendicular to the conveyance direction, an amount of misregistration 43D_1 and an amount of misregistration 43D_2 in the direction perpendicular to the conveyance direction, calculated from the respective misregistration detection patterns sets, are expressed by:

$$43D_1=42BK_1-42M_1, \text{ and}$$

$$43D_2=42M_2-42BK2, \text{ respectively.}$$

In FIG. 8A, the detection point of the sensor 17 or 19 is indicated by a one-dot chain line 500. If there is no misregistration, the second magenta misregistration detection pattern 25M_S1 is created as indicated by a dotted line. However, since there is the amount of misregistration 43D_1, a midpoint $O_1$ of the second magenta misregistration is detection pattern 25M_S1 deviates in the conveyance direction by a distance OM1. As illustrated in FIG. 8B, which is an enlarged view of the broken-line circled portion B of FIG. 8A, this distance OM1 is equal to the amount of misregistration 43D_1 because the second magenta misregistration detection pattern 25M_S1 is at an angle of $\pi/4$ with the direction perpendicular to the conveyance direction. Since the actual value of the interval 42M_1 is less than what the interval 42M_1 is supposed to be, which is equal to the interval 42BK_1, by the distance OM1, the amount of misregistration 43D_1 is obtained by subtracting the interval 42M_1 from the interval 42BK_1. Likewise, the third magenta misregistration detection pattern 25M_S2 without misregistration is indicated by a dotted line. For the same reason as in the case of the second magenta misregistration detection pattern 25M_S1, a midpoint deviation (distance) OM2 is equal to the amount of misregistration 43D_2. Since the actual value of the interval 42M_2 is more than what the interval 42M_2 is supposed to be, which is equal to the interval 42BK_2, by the distance OM2, the amount of misregistration 43D_2 is obtained by subtracting the interval 42BK_2 from the interval 42M_2.

The amount of misregistration DA of the magenta image relative to the black image in the direction perpendicular to the conveyance direction is expressed by the average of the amount of misregistration 43D_1 and the amount of misregistration 43_D2 as follows:

$$DA=(43_D1+43_D2)/2.$$

Further, the amount of misregistration DB of the magenta image relative to the black image in the conveyance direction is determined by calculating the difference between a detected value 44D_1 of a distance between the first black misregistration detection pattern 25BK_Y1 and the first magenta misregistration detection pattern 25M_Y1 and a desired distance between the first black misregistration detection pattern 25BK_Y1 and the first magenta misregistration detection pattern 25M_Y1 (supposed to be created by the misregistration amount detector 100), or by calculating the difference between a detected value 44D_2 of a distance between the first black misregistration detection pattern 25BK_Y2 and the first magenta misregistration detection pattern 25M_Y2 and a desired distance between the first black misregistration detection pattern 25BK_Y2 and the first magenta misregistration detection pattern 25M_Y2 (supposed to be created by the misregistration amount detector 100). The amount of misregistration DB of the magenta image relative to the black image in the conveyance direction may also be determined by calculating and averaging the detected values 44D_1 and 44D_2.

(b) Correction of Calculated Amount of Misregistration

Figure 9:
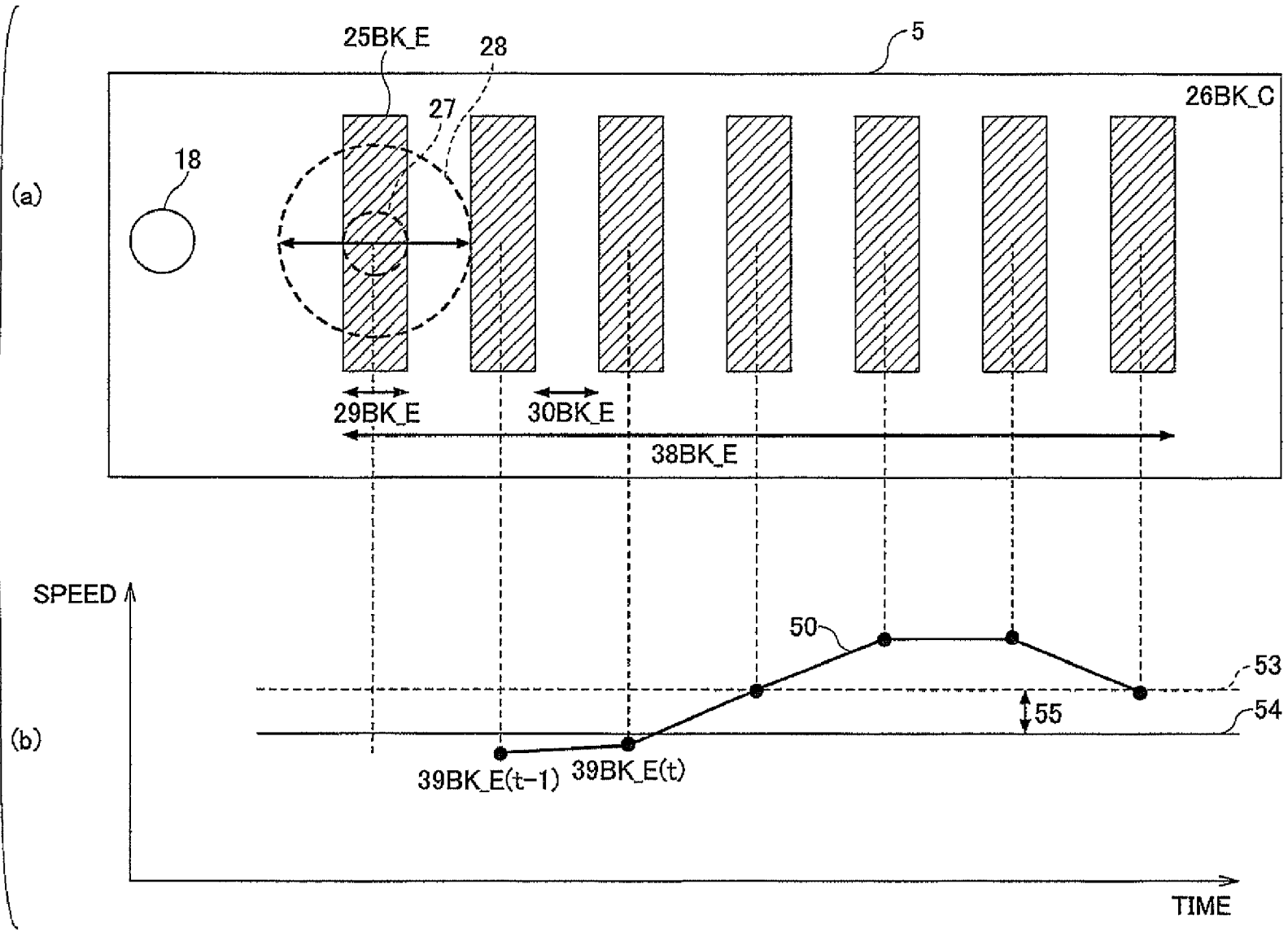
FIG. 9 is a diagram illustrating the principle of calculating conveyance speed from conveyance speed detection patterns according to the embodiment of the present invention.

First, a description is given, with reference to FIG. 9, of calculation of the surface conveyance speed (velocity) of the conveyor belt 5 using conveyance speed detection patterns according to this embodiment. FIG. 9 is a diagram illustrating the principle of calculating the conveyance speed of the conveyor belt 5 from the conveyance speed detection patterns 25BK_E.

Referring to (a) of FIG. 9 as well as FIG. 4, each conveyance speed detection pattern 25BK_E has a width 29BK_E, the conveyance speed detection patterns 25BK_E are arranged at regular intervals 30BK_E, and there is the interval (distance) 38BK_E between the start point and end point of the conveyance speed detection pattern column 26BK_C. Further, referring to the graph of (b) of FIG. 9, reference numeral 50 indicates the conveyance speed of the conveyance belt 5 at each point of time calculated from the detection result of the pattern column 26BK_C, reference numeral 53 indicates the average conveyance speed in the interval 38BK_E between the start point and end point of the pattern column 26BK_C, and reference numeral 54 indicates a desired conveyance speed of the conveyance belt 5. Further, the ratio of the average conveyance speed 53 to the desired conveyance speed 54 (average conveyance speed 53/desired conveyance speed 54) is expressed by a correction coefficient 55 for correcting detection error. Further, the vertical axis represents speed and the horizontal axis represents the time of detection of the conveyance speed detection pattern 26BK_E.

The conveyance speed 50, or the conveyance speed of the conveyor belt 5 at each point of time, is calculated by dividing the total value (sum) of the width 29BK_E of the conveyance speed detection pattern 25BK_E and the interval 30BK_E between each adjacent two of the conveyance speed detection patterns 25BK_E by the difference between a time 39BK_E (t) at which one conveyance speed detection pattern 25BK_E is detected and a time 39BK_E(t−1) at which a conveyance speed detection pattern 25BK_E immediately preceding the one conveyance speed detection pattern 25BK_E is detected. The average conveyance speed 53 is calculated by averaging the thus calculated conveyance speed 50 of the conveyor belt 5 over the entire interval.

Here, the conveyor belt 5 is not uniform in thickness over its length. Therefore, there is an error between the average conveyance speed 53, which is the surface velocity of the conveyor belt 5, and the desired conveyance speed 54 of the conveyor belt 5.

The amount of misregistration DA of the magenta image relative to the black image in the direction perpendicular to the conveyance direction and the amount of misregistration DB of the magenta image relative to the black image in the conveyance direction, which are calculated using the desired conveyance speed 54 of the conveyor belt 5, therefore contain a detection error corresponding to the difference between the average conveyance speed 53 and the desired conveyance speed 54. For example, the interval 42M_1 (FIG. 8A) used to determine the amount of misregistration DA may be calculated by multiplying the desired conveyance speed 54 by the difference in time between the first magenta misregistration detection pattern 25M_Y1 and the second magenta misregistration detection pattern 25M_S1 detected by the sensor 17 or 19. For example, the distance (detected value) 44D_1 may be calculated by multiplying the desired conveyance speed 54 by the difference in time between the first black misregistration detection pattern 25BK_Y1 and the first magenta misregistration detection pattern 25M_Y1 detected by the sensor 17 or 19.

Therefore, an amount of misregistration DA' of the magenta image relative to the black image in the direction perpendicular to the conveyance direction, which excludes the above-described detection error, and an amount of misregistration DB' of the magenta image relative to the black image in the conveyance direction, which excludes the above-described detection error, can be expressed by:

$$DA' = \text{Detection Error Correction Coefficient } 55 \times DA, \text{ and}$$

$$DB' = \text{Detection Error Correction Coefficient } 55 \times DB, \text{ respectively.}$$

Thus, by correcting the amount of misregistration calculated from the detection result of misregistration detection patterns using the detection result of conveyance speed detection patterns, it is possible to improve the accuracy of detection of the amount of misregistration.

On the other hand, the average conveyance speed 53 calculated using the detection result of conveyance speed detection patterns may be used in place of the desired conveyance speed 54 in calculating the amount of misregistration DA of the magenta image relative to the black image in the direction perpendicular to the conveyance direction and the amount of misregistration DB of the magenta image relative to the black image in the conveyance direction. As a result, it is possible to calculate the amount of misregistration that does not contain detection error caused by the difference between the average conveyance speed 53 and the desired conveyance speed 54.

(c) Calculation Unit of Misregistration Amount Detector 100

Figure 10:
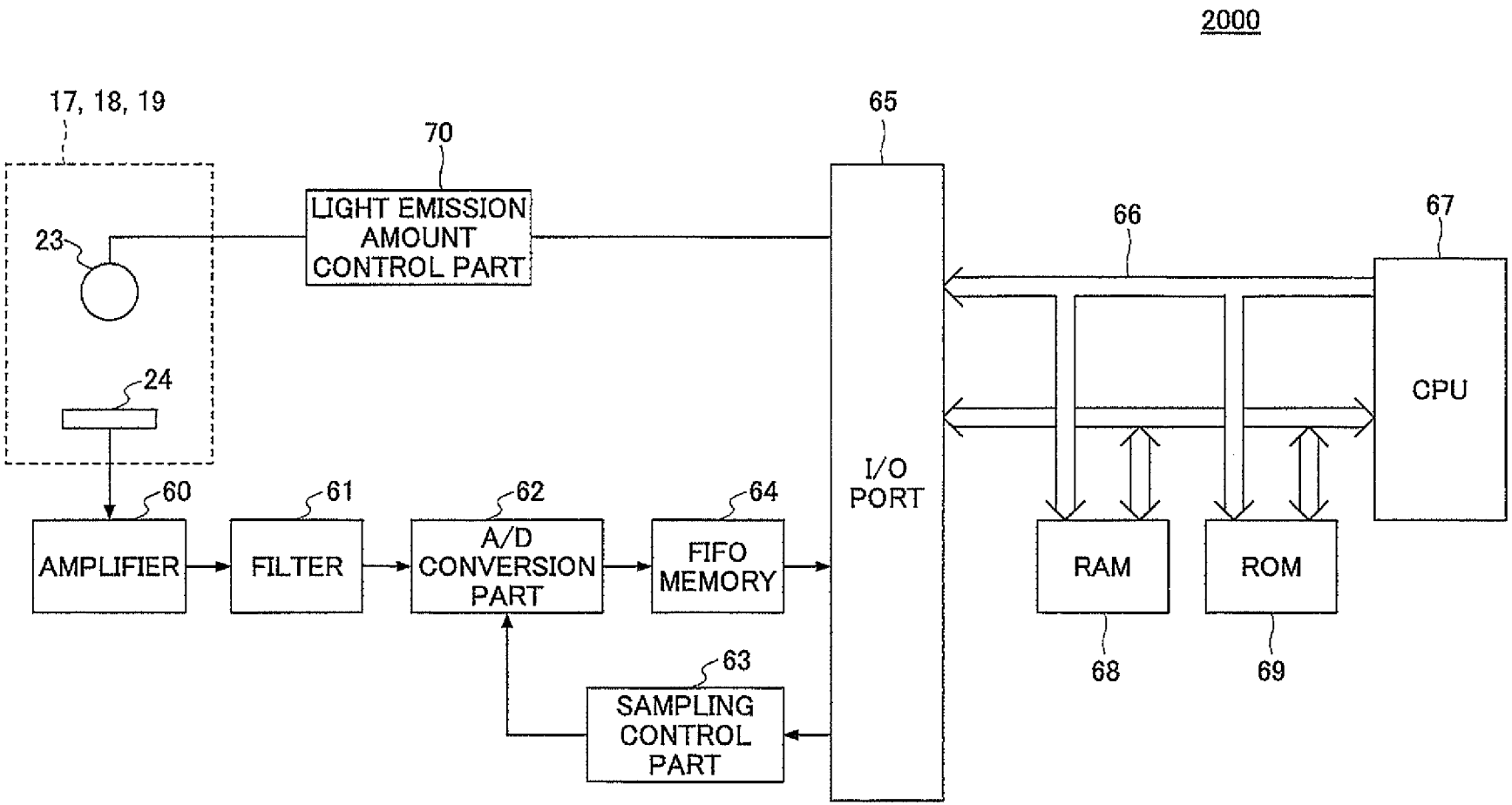
FIG. 10 is a block diagram illustrating a configuration of a calculation unit according to the embodiment of the present invention.

Next, a description is given, with reference to FIG. 10, of a configuration and operations of a calculation unit 2000 of the misregistration amount detector 100 according to this embodiment. FIG. 10 is a block diagram illustrating a configuration of the calculation unit 2000, which includes the first calculation part 220, the second calculation part 230, the third calculation part 240, and the calculation part 260.

The calculation unit 2000 according to this embodiment includes an amplifier 60, a filter 61, an analog-to-digital (A/D) conversion part 62, a sampling control part 63, a first-in first-out (FIFO) memory 64, an input/output (I/O) port 65, a data bus 66, a central processing unit (CPU) 67, a RAM 68, a read-only memory (ROM) 69, and a light emission amount control part 70.

A reflected light signal received by the reception part 24 (also FIG. 5) is amplified by the amplifier 60. Then, only a signal component detecting the misregistration correction pattern 25 is extracted from the amplified signal using the filter 61. Next, the reflected light signal is converted from analog data into digital data by the A/D conversion part 62. Data sampling accompanying this A/D conversion is controlled by the sampling control part 63. The sampled signal is stored in the FIFO memory 64.

After all the misregistration correction pattern 25 formed of the four colors of black, magenta, cyan, and yellow has been detected, the data contained in the FIFO memory 64 are loaded into the RAM 68 through the I/O port 65 and the data bus 66. The CPU 67 performs a computation that calculates the above-described amounts of misregistration on the data loaded into the RAM 68.

The ROM 69 contains various programs for controlling the misregistration amount detector 100 according to this embodiment, such as a program for calculating the above-described amounts of misregistration. Further, the CPU 67 monitors a detection signal from the light-receiving part 24 with appropriate timing, and controls the amount of light emission through the light emission amount control part 70 so as to ensure detection even if the conveyor belt 5 and the light-emission part 23 degrade, thereby making the level of the received light signal from the light-reception part 24 always constant. Thus, the CPU 67 and the ROM 69 operate as a control part that controls the operation of the entire misregistration amount detector 100.

(Operating Procedure of Misregistration Amount Detector 100 According to this Embodiment)

(a) Misregistration Amount Calculation (First Processing)

Figure 11:
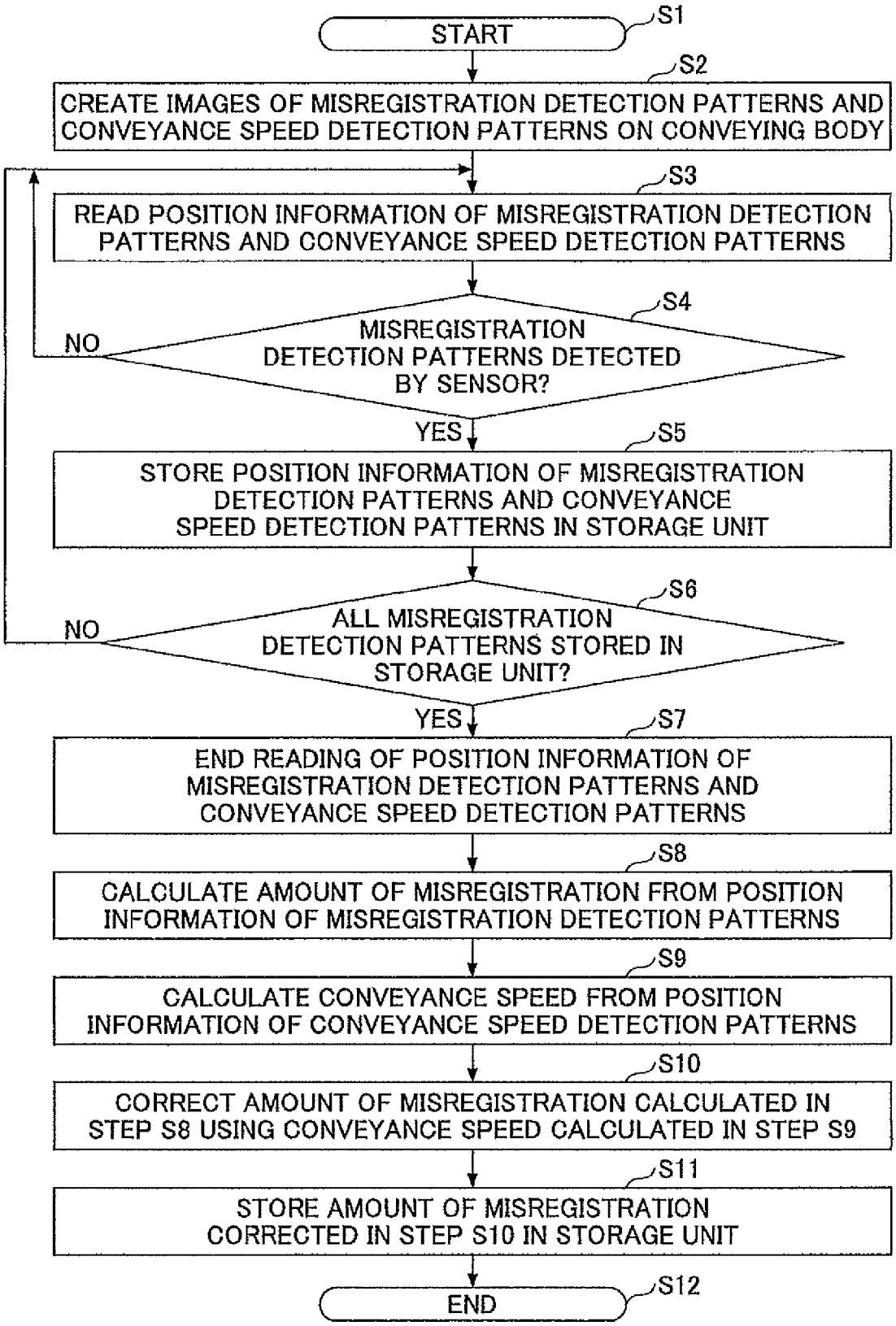
FIG. 11 is a flowchart illustrating a procedure for calculating the amount of misregistration (first processing) in the misregistration amount detector according to the embodiment of the present invention.

A description is given, with reference to FIG. 11, of calculation of the amount of misregistration (first processing) in the misregistration amount detector 100 according to this embodiment. FIG. 11 is a flowchart illustrating a procedure for calculating the amount of misregistration (first processing) in the misregistration amount detector 100 according to this embodiment.

Here, calculation of the amount of misregistration (first processing) refers to the processing of calculating the amount of misregistration using the detection results of the misregistration detection pattern columns 26FC_R and 26FC_L and the desired conveyance speed 54, thereafter correcting this amount of misregistration using the average conveyance speed 53 calculated using the detection result of the conveyance speed detection pattern column 26BK_C, and calculating the amount of misregistration from which detection error is removed.

Referring to FIG. 11, in step S1, the misregistration amount detector 100 starts processing. In step S2, the image creating part 200 (the image forming parts 6BK, 6M, 6C, and 6Y) creates the images of the misregistration detection pattern columns 26FC_R and 26FC_L and the conveyance speed detection pattern column 26BK_C according to this embodiment illustrated in FIG. 4 on the conveyor belt 5. First, the image forming part 6BK forms black toner images, then the image forming part 6M forms magenta toner images, then the image forming part 6C forms cyan toner images, and finally the image forming part 6Y forms yellow toner images on the conveyor belt 5 moving in the conveyance direction.

Here, the conventional misregistration correction pattern is created on the conveyor belt for the overall length or more (one turn or more) of a conveyor belt in order to cancel the effect of detection error due to the non-uniformity of the thickness of the conveyor belt. On the other hand, according to this embodiment, the detection error is eliminated by calculating the actual conveyance speed of the conveyor belt 5 by detecting the conveyance speed detection patterns 25BK_E. Accordingly, as illustrated in FIG. 4, the overall length 38BK_E of the misregistration correction pattern 25 in the conveyance direction may be twice the circumference of the photosensitive body drum 9BK and less than or equal to a third of the overall length (one turn) of the conveyor belt 5.

In step S3, the reading part 210 reads the misregistration correction pattern 25. The sensor 17 reads the misregistration detection pattern column 26FC_L created on the conveyor belt 5, the sensor 18 reads the conveyance speed detection pattern column 26BK_C created on the conveyor belt 5, and the sensor 19 reads the misregistration detection pattern column 26FC_R created on the conveyor belt 5. Specifically, the light-emitting part 23 of each of the sensors 17, 18, and 19 emits exposure light onto the misregistration correction pattern 25 formed on the conveyor belt 5, and the light-receiving part 24 receives its reflected light, so that the misregistration correction pattern 25 is detected. Since the sensor 19 operates in the same manner and performs the same processing on the received light signal as the sensor 17, a description of the sensor 19 is omitted in the following description.

The signal of the light received by the sensor 17 in step S3 is provisionally stored in the FIFO memory 64 through the amplifier 60, the filter 61, and the A/D conversion part 62. The signal of the light received by the sensor 18 is also provisionally stored in the FIFO memory 64 through the amplifier 60, the filter 61, and the A/D conversion part 62.

Then, in step S4, it is determined whether the sensor 17 has detected a single set of misregistration detection patterns (eight misregistration detection patterns, for example, the first misregistration detection patterns 25BK_Y1, 25M_Y1, 25C_Y1, and 25Y_Y1 and the second misregistration detection patterns 25BK_S1, 25M_S1, 25C_S1, and 25Y_S1, or the first misregistration detection patterns 25BK_Y2, 25M_Y2, 25C_Y2, and 25Y_Y2 and the third misregistration detection patterns 25BK_S2, 25M_S2, 25C_S2, and 25Y_S2). If it is determined in step 34 that the sensor 17 has detected a single set of misregistration detection patterns (YES in step S4), in step S5, the received light signal of the sensor 17 stored in the FIFO memory 64 is stored in the RAM 68 through the I/O port 65 and the data bus 66. Simultaneously, the received light signal of the sensor 18 stored in the FIFO memory 64 is also stored in the RAM 68 through the I/O port 65 and the data bus 66.

If it is determined in step S4 that the sensor 17 has not detected a single set of misregistration detection patterns (NO in step S4), in step S3, the sensor 17 continues to read misregistration detection patterns and the sensor 18 also continues to read conveyance speed detection patterns.

Next, in step S6, it is determined whether the sensor 17 has read all the misregistration detection patterns 25BK_Y1, 25M_Y1, 25C_Y1, 25Y_Y1, 25BK_Y2, 25M_Y2, 25C_Y2, 25Y_Y2, 25BK_S1, 25M_S1, 25C_S1, 25Y_S1, 25BK_S2, 25M_S2, 25C_S2, and 25Y_S2 illustrated in FIG. 4 and the entire signal of the light received by the sensor 17 has been stored in the RAM 68. If it is determined in step S6 that the sensor 17 has read all the misregistration detection patterns and the entire signal of the light received by the sensor 17 has been stored in the RAM 68 (YES in step S6), in step S7, the sensor 17 ends the reading of misregistration detection patterns and the sensor 18 also ends the reading of conveyance speed detection patterns.

If it is determined in step S6 that the sensor 17 has not read all the misregistration detection patterns (NO in step S6), in step S3, the sensor 17 continues to read misregistration detection patterns and the sensor 18 also continues to read conveyance speed detection patterns.

In step S8, the first calculation part 220 (FIG. 1) calculates the amount of misregistration 43D_1 (FIG. 8A) with respect to each of magenta, cyan, and yellow colors using the position information of the first misregistration detection patterns 25BK_Y1, 25M_Y1, 25C_Y1, and 25Y_Y1 and the second misregistration detection patterns 25BK_S1, 25M_S1, 25C_S1, and 25Y_S1 (the former two sets in FIG. 4) retained in the RAM 68. In the case of magenta, the amount of misregistration 43D_1 is calculated with respect to the black misregistration detection patterns 25BK_Y1 and 25BK_S1 and the magenta misregistration detection patterns 25M_Y1 and 25M_S1 included in the former two sets of FIG. 4 on a set-by-set basis, and the average of the amounts of misregistration 43D_1 is calculated. The same processing is performed with respect to cyan and yellow.

In step S8, the first calculation part 220 further calculates the amount of misregistration 43D_2 (FIG. 8A) with respect to each of magenta, cyan, and yellow colors using the position information of the first misregistration detection patterns 25BK_Y2, 25M_Y2, 25C_Y2, and 25Y_Y2 and the third misregistration detection patterns 25BK_S2, 25M_S2, 25C_S2, and 25Y_S2 (the latter two sets in FIG. 4) retained in the RAM 68. In the case of magenta, the amount of misregistration 43D_2 is calculated with respect to the black misregistration detection patterns 25BK_Y2 and 25BK_S2 and the magenta misregistration detection patterns 25M_Y2 and 25M_S2 included in the latter two sets of FIG. 4 on a set-by-set basis, and the average of the amounts of misregistration 43D_2 is calculated. The same processing is performed with respect to cyan and yellow.

Then, the first calculation part 220 calculates the average DA of the amount of misregistration 43D_1 and the amount of misregistration 43D_2 with respect to each of magenta, cyan, and yellow.

At the same time, the first calculation part 220 calculates the amount of misregistration DB of each of magenta, cyan, and yellow images relative to a black image in the conveyance direction. In calculating the amount of misregistration DB, the distance (detected value) 44D_1 in FIG. 8A is calculated with respect to each detection result (each set) of misregistration detection patterns and the average of the distances 44D_1 is calculated for each of magenta, cyan, and yellow.

In step S9, the second calculation part 230 calculates the average conveyance speed 53 using the position information of the conveyance speed detection patterns 25BK_E retained in the RAM 68. The second calculation part 230 calculates the conveyance speed 50 of the conveyor belt 5 at each point of time in FIG. 9 by dividing the total value (sum) of the width 29BK_E of the conveyance speed detection pattern 25BK_E and the interval 30BK_E between each adjacent two of the conveyance speed detection patterns 25BK_E by the difference between the time 39BK_E(t) at which one conveyance speed detection pattern 25BK_E is detected and the time 39BK_E(t−1) at which a conveyance speed detection pattern 25BK_E immediately preceding the one conveyance speed detection pattern 25BK_E is detected, the difference being retained in the RAM 68. Then, the second calculation part 230 calculates the average of the thus calculated conveyance speed 50 over the entire interval, and determines the calculated average as the average conveyance speed 53.

In step S10, the third calculation part 240 multiplies the above-described amounts of misregistration DA and DB by the detection error correction coefficient 55, which is the ratio of the average conveyance speed 53 to the desired conveyance speed 54 calculated in step S9, with respect to each of magenta, cyan, and yellow, thereby calculating the amounts of misregistration DA' and DB', from which the detection error caused by the difference between the actual conveyance speed 53 and the desired conveyance speed 54 of the conveyor belt 5 is eliminated, with respect to each of magenta, cyan, and yellow.

In step S11, the storage part 250 stores the amounts of misregistration DA' and DB' calculated in step S10 in the RAM 68, and in step S12, the processing of the misregistration amount detector 100 according to this embodiment ends.

Thereby, the misregistration amount detector 100 can be provided, which makes it possible to detect misregistration in a shorter period of time than the misregistration correction based on the conventional misregistration correction pattern without detection error due to the unevenness (non-uniformity) of the thickness of a conveyor belt.

(b) Misregistration Amount Calculation (Second Processing)

Figure 12:
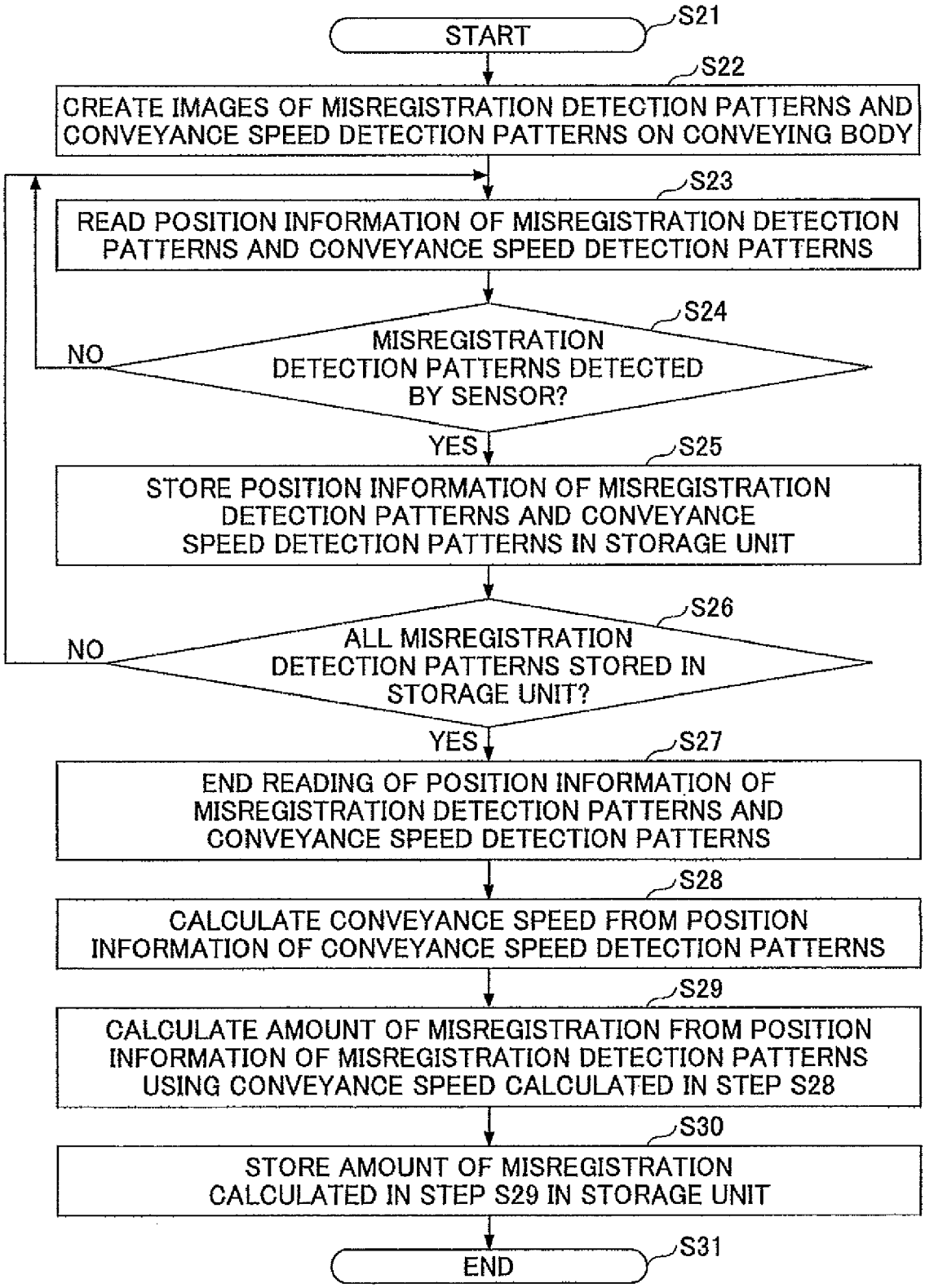
FIG. 12 is a flowchart illustrating a procedure for calculating the amount of misregistration (second processing) in the misregistration amount detector according to the embodiment of the present invention.

A description is given, with reference to FIG. 12, of calculation of the amount of misregistration (second processing) in the misregistration amount detector 100 according to this embodiment. FIG. 12 is a flowchart illustrating a procedure for calculating the amount of misregistration (second processing) in the misregistration amount detector 100 according to this embodiment.

Here, according to the calculation of the amount of misregistration (first processing), the amount of misregistration is provisionally calculated using the desired conveyance speed 54, and thereafter, the amount of misregistration is corrected by multiplying the amount of misregistration by the detection error correction coefficient 55, thereby eliminating detection error due to the unevenness (non-uniformity) of the thickness of the conveyor belt 5. On the other hand, according to the calculation of the amount of misregistration (second processing), the amount of misregistration is calculated using the actual conveyance speed 53 of the conveyor belt 5 calculated from the detection results of the conveyance speed detection pattern column 26BK_C in place of the desired conveyance speed 54.

Referring to FIG. 12, in step S21, the misregistration amount detector 100 starts processing. In step S22, the image creating part 200 (the image forming parts 6BK, 6M, 6C, and 6Y) creates the images of the misregistration detection pattern columns 26FC_R and 26FC_L and the conveyance speed detection pattern column 26BK_C according to this embodiment illustrated in FIG. 4 on the conveyor belt 5. First, the image forming part 6BK forms black toner images, then the image forming part 6M forms magenta toner images, then the image forming part 6C forms cyan toner images, and finally the image forming part 6Y forms yellow toner images on the conveyor belt 5 moving in the conveyance direction.

Here, the conventional misregistration correction pattern is created on the conveyor belt for the overall length or more (one turn or more) of a conveyor belt in order to cancel the effect of detection error due to the non-uniformity of the thickness of the conveyor belt. On the other hand, according to this embodiment, the detection error is eliminated by calculating the actual conveyance speed of the conveyor belt 5 by detecting the conveyance speed detection patterns 25BK_E. Accordingly, as illustrated in FIG. 4, the overall length 38BK_E of the misregistration correction pattern 25 in the conveyance direction may be twice the circumference of the photosensitive body drum 9BK and less than or equal to a third of the overall length (one turn) of the conveyor belt 5.

In step S23, the reading part 210 reads the misregistration correction pattern 25. The sensor 17 reads the misregistration detection pattern column 26FC_L created on the conveyor belt 5, the sensor 18 reads the conveyance speed detection pattern column 26BK_C created on the conveyor belt 5, and the sensor 19 reads the misregistration detection pattern column 26FC_R created on the conveyor belt 5. Specifically, the light-emitting part 23 of each of the sensors 17, 18, and 19 emits exposure light onto corresponding misregistration detection patterns or conveyance speed detection patterns formed on the conveyor belt 5, and the light-receiving part 24 receives its reflected light, so that the misregistration detection patterns and the conveyance speed detection patterns are detected. Since the sensor 19 operates in the same manner and performs the same processing on the received light signal as the sensor 17, a description of the sensor 19 is omitted in the following description.

The signal of the light received by the sensor 17 in step S23 is provisionally stored in the FIFO memory 64 through the amplifier 60, the filter 61, and the A/D conversion part 62. The signal of the light received by the sensor 18 is also provisionally stored in the FIFO memory 64 through the amplifier 60, the filter 61, and the A/D conversion part 62.

Then, in step S24, it is determined whether the sensor 17 has detected a single set of misregistration detection patterns (eight misregistration detection patterns, for example, the first misregistration detection patterns 25BK_Y1, 25M_Y1, 25C_Y1, and 25Y_Y1 and the second misregistration detection patterns 25BK_S1, 25M_S1, 25C_S1, and 25Y_S1, or the first misregistration detection patterns 25BK_Y2, 25M_Y2, 25C_Y2, and 25Y_Y2 and the third misregistration detection patterns 25BK_S2, 25M_S2, 25C_S2, and 25Y_S2). If it is determined in step S24 that the sensor 17 has detected a single set of misregistration detection patterns (YES in step S24), in step S25, the received light signal of the sensor 17 stored in the FIFO memory 64 is stored in the RAM 68 through the I/O port 65 and the data bus 66. Simultaneously, the received light signal of the sensor 18 stored in the FIFO memory 64 is also stored in the RAM 68 through the I/O port 65 and the data bus 66.

If it is determined in step S24 that the sensor 17 has not detected a single set of misregistration detection patterns (NO in step S24), in step S23, the sensor 17 continues to read misregistration detection patterns and the sensor 18 also continues to read conveyance speed detection patterns.

Next, in step S26, it is determined whether the sensor 17 has read all the misregistration detection patterns 25BK_Y1, 25M_Y1, 25C_Y1, 25Y_Y1, 25BK_Y2, 25M_Y2, 25C_Y2, 25Y_Y2, 25BK_S1, 25M_S1, 25C_S1, 25Y_S1, 25BK_S2, 25M_S2, 25C_S2, and 25Y_S2 illustrated in FIG. 4 and the entire signal of the light received by the sensor 17 has been stored in the RAM 68. If it is determined in step S26 that the sensor 17 has read all the misregistration detection patterns and the entire signal of the light received by the sensor 17 has been stored in the RAM 68 (YES in step S26), in step S27, the sensor 17 ends the reading of misregistration detection patterns and the sensor 18 also ends the reading of conveyance speed detection patterns.

If it is determined in step S26 that the sensor 17 has not read all the misregistration detection patterns (NO in step S26), in step S23, the sensor 17 continues to read misregistration detection patterns and the sensor 18 also continues to read conveyance speed detection patterns.

In step S28, the calculation part 260 (FIG. 1) calculates the average conveyance speed 53 using the position information of the conveyance speed detection patterns 25BK_E retained in the RAM 68. The calculation part 260 calculates the conveyance speed 50 of the conveyor belt 5 at each point of time in FIG. 9 by dividing the total value (sum) of the width 29BK_E of the conveyance speed detection pattern 25BK_E and the interval 30BK_E between each adjacent two of the conveyance speed detection patterns 25BK_E by the difference between the time 39BK_E(t) at which one conveyance speed detection pattern 25BK_E is detected and the time 39BK_E(t−1) at which a conveyance speed detection pattern 25BK_E immediately preceding the one conveyance speed detection pattern 25BK_E is detected, the difference being retained in the RAM 68. Then, the calculation part 260 calculates the average of the thus calculated conveyance speed 50 over the entire interval, and determines the calculated average as the average conveyance speed 53.

In step S29, the calculation part 260 calculates the amount of misregistration 43D_1 (FIG. 8A) with respect to each of magenta, cyan, and yellow colors using the position information of the first misregistration detection patterns 25BK_Y1, 25M_Y1, 25C_Y1, and 25Y_Y1 and the second misregistration detection patterns 25BK_S1, 25M_S1, 25C_S1, and 25Y_S1 (the former two sets in FIG. 4) and the average conveyance speed 53 retained in the RAM 68. In the case of magenta, the amount of misregistration 43D_1 is calculated with respect to the black misregistration detection patterns 25BK_Y1 and 25BK_S1 and the magenta misregistration detection patterns 25M_Y1 and 25M_S1 included in the former two sets of FIG. 4 on a set-by-set basis, and the average of the amounts of misregistration 43D_1 is calculated. The same processing is performed with respect to cyan and yellow.

In step S29, the calculation part 260 further calculates the amount of misregistration 43D_2 (FIG. 8A) with respect to each of magenta, cyan, and yellow colors using the position information of the first misregistration detection patterns 25BK_Y2, 25M_Y2, 25C_Y2, and 25Y_Y2 and the third misregistration detection patterns 25BK_S2, 25M_S2, 25C_S2, and 25Y_S2 (the latter two sets in FIG. 4) and the average conveyance speed 53 retained in the RAM 68. In the case of magenta, the amount of misregistration 43D_2 is calculated with respect to the black misregistration detection patterns 25BK_Y2 and 25BK_S2 and the magenta misregistration detection patterns 25M_Y2 and 25M_S2 included in the latter two sets of FIG. 4 on a set-by-set basis, and the average of the amounts of misregistration 43D_2 is calculated. The same processing is performed with respect to cyan and yellow.

Then, the calculation part 260 calculates the average DA of the amount of misregistration 43D_1 and the amount of misregistration 43D_2 with respect to each of magenta, cyan, and yellow.

At the same time, the calculation part 260 calculates the amount of misregistration DB of each of magenta, cyan, and yellow images relative to a black image in the conveyance direction, using the detection results of the first misregistration detection patterns 25BK_Y1, 25M_Y1, 25C_Y1 and 25Y_Y1 and the average conveyance speed 53. In calculating the amount of misregistration DB, the distance (detected value) 44D_1 in FIG. 8A is calculated with respect to each detection result (each set) of misregistration detection patterns and the average of the distances 44D_1 is calculated for each of magenta, cyan, and yellow.

In step S30, the storage part 250 stores the amounts of misregistration DA and DB in the RAM 68, and in step S31, the processing of the misregistration amount detector 100 according to this embodiment ends.

Thereby, the misregistration amount detector 100 can be provided, which makes it possible to detect misregistration in a shorter period of time than the misregistration correction based on the conventional misregistration correction pattern without detection error due to the unevenness (non-uniformity) of the thickness of a conveyor belt.

The present invention is not limited to the specifically disclosed embodiment(s), and variations and modifications may be made without departing from the scope of the present invention.

The present application is based on Japanese Priority Patent Application No. 2007-334400, filed on Dec. 26, 2007, the entire contents of which are hereby incorporated by reference.

What is claimed is:

1. A misregistration amount detector in a tandem image forming apparatus having a conveying body configured to convey paper on which a color image is to be printed, the misregistration amount detector comprising:

an image creating part configured to create, on the conveying body, a first pattern for detecting an amount of misregistration of an image position related to a first color relative to an image position related to a second color other than the first color and a second pattern for measuring a conveyance speed of the conveying body, the first pattern and the second pattern being side by side in a conveyance direction of the conveying body; and a reading part configured to read the first pattern and the second pattern created on the conveying body by the image creating part.

2. The misregistration amount detector as claimed in claim 1, further comprising:

a first calculation part configured to calculate the amount of misregistration based on a result of reading the first pattern by the reading part;

a second calculation part configured to calculate the conveyance speed of the conveying body based on a result of reading the second pattern by the reading part; and a third calculation part configured to correct the amount of misregistration calculated by the first calculation part using the conveyance speed of the conveying body calculated by the second calculation part.

3. The misregistration amount detector as claimed in claim 1, further comprising:

a calculation part configured to calculate the conveyance speed of the conveying body based on a result of reading the second pattern by the reading part and to calculate the amount of misregistration based on the conveyance speed and a result of reading the first pattern by the reading part.

4. The misregistration amount detector as claimed in claim 1, wherein the second pattern includes a plurality of equally-shaped patterns spaced at equal intervals in the conveyance direction of the conveying body, the plurality of patterns each being single-colored.

5. A misregistration amount detecting method in a tandem image forming apparatus having a conveying body configured to convey paper on which a color image is to be printed, the misregistration amount detecting method comprising the steps of:

(a) creating, on the conveying body, a first pattern for detecting an amount of misregistration of an image position related to a first color relative to an image position related to a second color other than the first color and a second pattern for measuring a conveyance speed of the conveying body, the first pattern and the second pattern being side by side in a conveyance direction of the conveying body; and (b) reading the first pattern and the second pattern created on the conveying body by the image creating part.

6. The misregistration amount detecting method as claimed in claim 5, further comprising the steps of:

(c) calculating the amount of misregistration based on a result of reading the first pattern by said step (b);

(d) calculating the conveyance speed of the conveying body based on a result of reading the second pattern by said step (b); and (e) correcting the amount of misregistration calculated by said step (c) using the conveyance speed of the conveying body calculated by said step (d).

7. The misregistration amount detecting method as claimed in claim 5, further comprising the step of:

(c) calculating the conveyance speed of the conveying body based on a result of reading the second pattern by said step (b) and calculating the amount of misregistration based on the conveyance speed and a result of reading the first pattern by said step (b).

8. The misregistration amount detecting method as claimed in claim 5, wherein the second pattern includes a plurality of equally-shaped patterns spaced at equal intervals in the conveyance direction of the conveying body, the plurality of patterns each being single-colored.

9. A computer-readable storage medium storing a program for causing a computer to execute a misregistration amount detecting method in a tandem image forming apparatus having a conveying body configured to convey paper on which a color image is to be printed, wherein the misregistration amount detecting method includes the steps of:

(a) creating, on the conveying body, a first pattern for detecting an amount of misregistration of an image position related to a first color relative to an image position related to a second color other than the first color and a second pattern for measuring a conveyance speed of the conveying body, the first pattern and the second pattern being side by side in a conveyance direction of the conveying body; and (b) reading the first pattern and the second pattern created on the conveying body by the image creating part.

10. The computer-readable storage medium as claimed in claim 9, wherein the misregistration amount detecting method further includes the steps of:

(c) calculating the amount of misregistration based on a result of reading the first pattern by said step (b);

(d) calculating the conveyance speed of the conveying body based on a result of reading the second pattern by said step (b); and (e) correcting the amount of misregistration calculated by said step (c) using the conveyance speed of the conveying body calculated by said step (d).

11. The computer-readable storage medium as claimed in claim 9, wherein the misregistration amount detecting method further includes the step of:

(c) calculating the conveyance speed of the conveying body based on a result of reading the second pattern by said step (b) and calculating the amount of misregistration based on the conveyance speed and a result of reading the first pattern by said step (b).

12. The computer-readable storage medium as claimed in claim 9, wherein the second pattern includes a plurality of equally-shaped patterns spaced at equal intervals in the conveyance direction of the conveying body, the plurality of patterns each being single-colored.

* * * * *